US012123280B2

(12) United States Patent
Webber et al.

(10) Patent No.: US 12,123,280 B2
(45) Date of Patent: Oct. 22, 2024

(54) PUMP OUT STAGE CEMENTING SYSTEM

(71) Applicant: FORUM US, INC., Houston, TX (US)

(72) Inventors: Andrew Webber, Hockley, TX (US); Jeffery Morrison, Missouri City, TX (US); Jeffry Ehlinger, Houston, TX (US)

(73) Assignee: FORUM US, INC., Houston, TX (US)

( * ) Notice: Subject to any disclaimer, the term of this patent is extended or adjusted under 35 U.S.C. 154(b) by 101 days.

(21) Appl. No.: 17/874,061

(22) Filed: Jul. 26, 2022

(65) Prior Publication Data

US 2024/0035356 A1 Feb. 1, 2024

(51) Int. Cl.

| | |
|---|---|
| ***E21B 33/14*** | (2006.01) |
| ***E21B 23/04*** | (2006.01) |
| ***E21B 23/06*** | (2006.01) |
| ***E21B 34/06*** | (2006.01) |

(52) U.S. Cl.
CPC ..... *E21B 33/146* (2013.01); *E21B 23/0413* (2020.05); *E21B 23/06* (2013.01); *E21B 34/063* (2013.01)

(58) Field of Classification Search
CPC ... E21B 33/146; E21B 34/063; E21B 2200/06
See application file for complete search history.

(56) References Cited

U.S. PATENT DOCUMENTS

| | | | | |
|---|---|---|---|---|
| 2,352,744 | A | 7/1944 | Stoddard | |
| 5,526,878 | A | 6/1996 | Duell et al. | |
| 2002/0174986 | A1 | 11/2002 | Szarka | |
| 2014/0224479 | A1* | 8/2014 | Andrigo | E21B 33/14 166/192 |
| 2015/0184489 | A1 | 7/2015 | Resweber | |
| 2017/0204700 | A1* | 7/2017 | Hughes | E21B 34/14 |
| 2017/0342800 | A1* | 11/2017 | Themig | E21B 34/063 |
| 2019/0264538 | A1* | 8/2019 | Bowersock | E21B 34/103 |
| 2022/0195835 | A1 | 6/2022 | Acosta Villareal et al. | |

OTHER PUBLICATIONS

International Search Report and Written Opinion issued in PCT App. No. PCT/US2023/028597, dated Oct. 30, 2023 (14 pages).

* cited by examiner

*Primary Examiner* — Theodore N Yao
(74) *Attorney, Agent, or Firm* — Ewing & Jones, PLLC

(57) ABSTRACT

Embodiments presented provide for an apparatus that provides a dislodgable plug seat that is used to capture a cement wiper plug for wellbore cementing operations. The apparatus further includes a collar having a ball seat and a closing sleeve configured to be shifted from an open position to a closed position. In the open position, a fluid pathway between an interior volume and a wellbore annulus is unblocked, and in the closed position the fluid pathway is blocked. A split ring is shiftable with the closing sleeve between a retained configuration when the closing sleeve is in the open position and an expanded configuration when the closing sleeve is in the closed position. The split ring holds the dislodgable plug seat in place within the body in the retained configuration and releases the dislodgable plug seat in the expanded configuration.

14 Claims, 26 Drawing Sheets

PUMP OUT STAGE CEMENTING SYSTEM

CROSS-REFERENCE TO RELATED APPLICATIONS

None

FIELD OF THE DISCLOSURE

Aspects of the disclosure relate to a cementing system for wellbore construction. More specifically, aspects of the disclosure relate to a pump down cementing system to allow for accurate cement placement and disengagement of components after cement placement.

BACKGROUND

Cementing is a process in wellbore construction that is important for the overall strength and integrity of the wellbore. The process of creation of a wellbore includes using an auger to drill into a geological system to an end point chosen during the well planning process. As will be understood, the auger must create a size of a wellbore that exceeds the overall outer diameter of the drill string, so that the drill string can fit within the established wellbore. At the end of the wellbore and placement of a casing within the wellbore, there is space between the outside diameter of the wellbore casing and the inside diameter of the wellbore. The casing, in this configuration, is inherently structurally unstable as there is no lateral bracing of the casing.

Cementing of the space between the outside of the wellbore casing and the wellbore establishes lateral support that is needed. Cementing also provides additional vertical weight to the overall drill string if vertical forces are experienced, such as during a well blow out.

While millions of wells have been created across the globe, industry strives to make the process of wellbore creation faster and more efficient. Conventional wellbore creation systems have several drawbacks that have not been solved. These drawbacks include excessive use of cement during the installation process, lack of bonding between the placed cement and drill string, failure to efficiently and directly place cement especially at the end of a wellbore string and excessive amounts of work required to successfully install cement. Problems are also created when cementing occurs at positions in the wellbore "off bottom". In instances where cementing must occur in specific locations, conventional apparatus have a difficult time in accurate placement and separation of cementing components when cementing stages are complete.

There is a need to provide an apparatus and methods for cementing that are easier to operate than conventional apparatus and methods.

There is a further need to provide apparatus and methods that do not have the drawbacks discussed above.

There is a still further need to reduce economic costs associated with operations and apparatus described above with conventional tools.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure and are therefore not to be considered limiting of its scope, for the disclosure may admit to other equally effective embodiments without specific recitation. Accordingly, the following summary provides just a few aspects of the description and should not be used to limit the described embodiments to a single concept.

In one example embodiment, the apparatus may comprise a body configured to define an interior volume and a collar having a seat configured within the interior volume of the body, the seat configured to channel flow through the interior volume and configured to accept a dropped ball. The apparatus may also be configured with a closing sleeve configured to extend from a first position to a second position, wherein in the first position, the closing sleeve is in an open position and in the second position, the closing sleeve is in a closed position. The apparatus may also be configured with a split ring configured within the interior volume located between the closing sleeve and the seat and a packer configured to extend from a first deflated position to a second inflated position. The apparatus may also be configured with a rupture disk and a plug configured to be placed within the interior volume, wherein an exterior of the plug is configured to extend to an interior diameter of the body.

In one example embodiment, a method for cementing a wellbore is disclosed. The method may comprise running an apparatus into the wellbore where cementing is to occur within the wellbore and dropping a ball within the apparatus, wherein the ball descends with gravity to an approximate elevation where cementing is to occur. The method may also comprise landing the ball on a seat within an interior volume of the apparatus and increasing a pressure within the apparatus. The method may also comprise setting a packer within an annulus of the wellbore after a pressure in the apparatus reaches a predefined limit. The method may also comprise rupturing a rupture disk with the apparatus to establish a flow of cement within the apparatus. The method may also comprise filling an annulus of the wellbore with cement from the flow of cement out an open sleeve within the apparatus and inserting a plug within the apparatus. The method may also comprise transporting the plug to the seat, moving the sleeve to a closed position and shearing a float collar within the apparatus.

In another example embodiment, an apparatus is disclosed. The apparatus may comprise a body configured to define an interior volume and a collar having a seat configured within the interior volume of the body, the seat configured to channel flow through the interior volume and configured to accept a dropped ball. The apparatus may also comprise a closing sleeve configured to extend from a first position to a second position, wherein in the first position, the closing sleeve is in an open position and in the second position, the closing sleeve is in a closed position. The apparatus may also comprise a split ring configured within the interior volume located between the closing sleeve and the seat. The apparatus may also comprise a packer configured with a float valve, the packer configured to extend from a first deflated position to a second inflated position. The apparatus may also comprise a rupture disk and a plug configured to be placed within the interior volume, wherein an exterior of the plug is configured to extend to an interior diameter of the body.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure and are therefore not be considered limiting of its scope, for the disclosure may admit to other equally effective embodiments.

Figure 1:
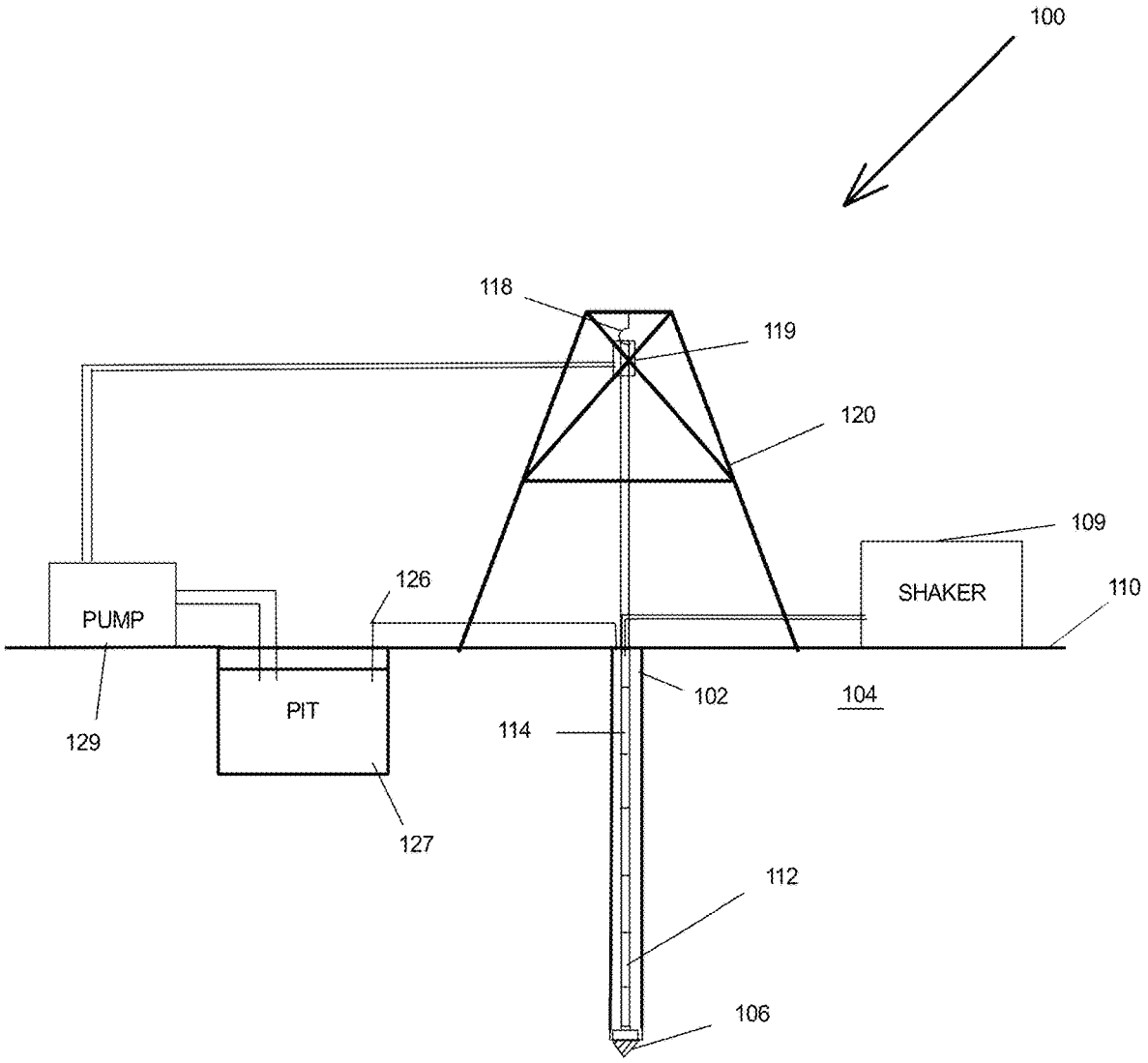
FIG. 1 is a drill rig performing a hydrocarbon recovery operation in one aspect of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, components, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Embodiments of the disclosure provide for a cementing system that provides for accurate placement of cement within a wellbore. The embodiments provides a pump down cementing system that is easily understandable by field personnel that provides for superior disconnection capabilities after the cementing has occurred, leading to less lost time for failure remediation. Embodiments provide for a stage tool, an ICP (packer) and float collar. In the embodiments illustrated, internal components shear and fall to the bottom of the well after cementing is complete. Embodiment provided are especially important in "off bottom" placement of cement. Such embodiments are used, for example, when different "pay zones" are located along a length of the wellbore. Such geological configurations are present in numerous locations.

Referring to FIG. 1, a rig 100 is illustrated. The purpose of the rig 100 is to recover oil and gas located beneath the ground level 110. Different geological layers 104 may be encountered during the creation of a wellbore 102. In FIG. 1, a single geological layer 104 layer is provided. As will be understood, multiple layers of geological layers 104 may be encountered. In embodiments, the geological layers 104 may be horizontally layers. In other embodiments, the geological layers 104 may be vertically configured. In still further embodiments, the geological layers 104 may have both horizontal and vertical layers. Geological layers 104 beneath the ground level 110 may be varied in composition, and may include sand, clay, silt, rock and/or combinations of these. Operators, therefore, need to assess the composition of the geological layers 104 in order to maximize penetration of a drill bit 106 that will be used in the drilling process. The wellbore 102 is formed within the geological layers 104 by a drill bit 106. In embodiments, the drill bit 106 is rotated such that contact between the drill bit 106 and the geological layers 104 causes portions ("cuttings") of the geological layers 104 to be loosened at the bottom of the wellbore 102. Differing types of drill bits 106 may be used to penetrate different types of geological layers 104. The types of geological layers 104 encountered, therefore, is an important characteristic for operators. The types of drill bits 106 may vary widely. In some embodiments polycrystalline diamond compact ("PDC") drill bits may be used. In other embodiments, roller cone bits, diamond impregnated or hammer bits may be used. In embodiments, during the drilling process, vibration may be placed upon the drill bit 106 to aid in the breaking of geological layers 104 that are encountered by the drill bit 106. Such vibration may increase the overall rate of penetration ("ROP"), increasing the efficiency of the drilling operations.

As the wellbore 102 penetrates further into the geological layers 104, operators may add portions of pipe 114 to form a drill string 112. As illustrated in FIG. 1, the drill string 112 may extend into the geological layers 104 in a vertical orientation. In other embodiments, the drill string 112 and the wellbore 102 may deviate from a vertical orientation. In some embodiments, the wellbore 102 may be drilled in certain sections in a horizontal direction, parallel with the ground level 110.

The drill bit 106 is larger in diameter than the drill string 112 such that when the drill bit 106 produces the hole for the wellbore 102, an annular space is created between the drill string 112 and the inside face of the wellbore 102. This annular space provides a pathway for removal of cuttings from the wellbore 102. Drilling fluids include water and specialty chemicals to aid in the formation of the wellbore. Other additives, such as defoamers, corrosion inhibitors, alkalinity control, bactericides, emulsifiers, wetting agents, filtration reducers, flocculants, foaming agents, lubricants, pipe-freeing agents, scale inhibitors, scavengers, surfactants, temperature stabilizers, scale inhibitors, thinners, dispersants, tracers, viscosifiers, and wetting agents may be added. This annular space must be cemented by equipment described later.

The drilling fluids may be stored in a pit 127 located at the drill site. The pit 127 may have a liner to prevent the drilling fluids from entering surface groundwater and/or contacting surface soils. In other embodiments, the drilling fluids may be stored in a tank alleviating the need for a pit 127. The pit 127 may have a recirculation line 126 that connects the pit 127 to a material separator 109 that is configured to process the drilling fluid after progressing from the downhole environment.

Drilling fluid from the pit 127 is pumped by a mud pump 129 that is connected to a swivel 119. The drill string 112 is suspended by a drive 118 from a derrick 120. In the illustrated embodiment, the drive 118 may be a unit that sits atop the drill string 112 and is known in the industry as a "top drive". The top drive is configured to provide the rotational motion of the drill string 112 and attached drill bit 106. Although the drill string 112 is illustrated as being rotated by a top drive, other configurations are possible. A rotary drive located at or near the ground level 110 may be used by operators to provide the rotational force. Power for the rotary drive or the top drive may be provided by diesel generators.

Drilling fluid is provided to the drill string 112 through a swivel 119 suspended by the derrick 120. The drilling fluid exits the drill string 112 at the drill bit 106 and has several functions in the drilling process. The drilling fluid is used to cool the drill bit 106 and remove the cuttings generated by the drill bit 106. The drilling fluid with the loosened cuttings enter the annular area outside of the drill string 112 and travel up the wellbore 102 to a material separator 109. The drilling fluid provides further information on the stratum being encountered and may be tested with a viscometer, for example, to determine formation properties. Such formation properties allow engineers the ability to determine if drilling should proceed or terminate.

The material separator 109 is configured to separate the cuttings from the drilling fluid. The cuttings, after separation, may be analyzed by operators to determine if the geological layers 104 currently being penetrated has hydrocarbons stored within the stratum level that is currently being penetrated by the drill bit 106. The drilling fluid is then recirculated to the pit 127 through the recirculation line 126. The material separator 109 separates the cuttings from the drilling fluid by providing an acceleration of the fluid on to a screening surface. As will be understood, the material separator 109 may provide a linear or cylindrical acceleration for the materials being processed through the material separator 109. In embodiments, the material separator 109 may be configured with one running speed. In other embodiments, the material separator 109 may be configured with multiple operating speeds. In embodiments, with material separator 109 may operate at multiple operating speeds.

As will be understood, smaller cuttings may pass entirely through the screens of the material separator 109 such that the fluids may include many smaller size cuttings. The overall quality of the drilling fluid, therefore, may be compromised by such smaller cuttings. The drilling fluid may be, as example, water based, oil based or synthetic based types of fluids. The fluid provide several functions, such as the capability to suspend and release cutting in the fluid flow, the control of formation pressures (pressures downhole), maintain wellbore stability, minimize formation damage, cool, lubricate and support the bit and drilling assembly, transmission of energy to tools and the bit, control corrosion and facilitate completion of the wellbore. In embodiments, the drilling fluid may also minimize environmental impact of the well construction process.

Figure 2:
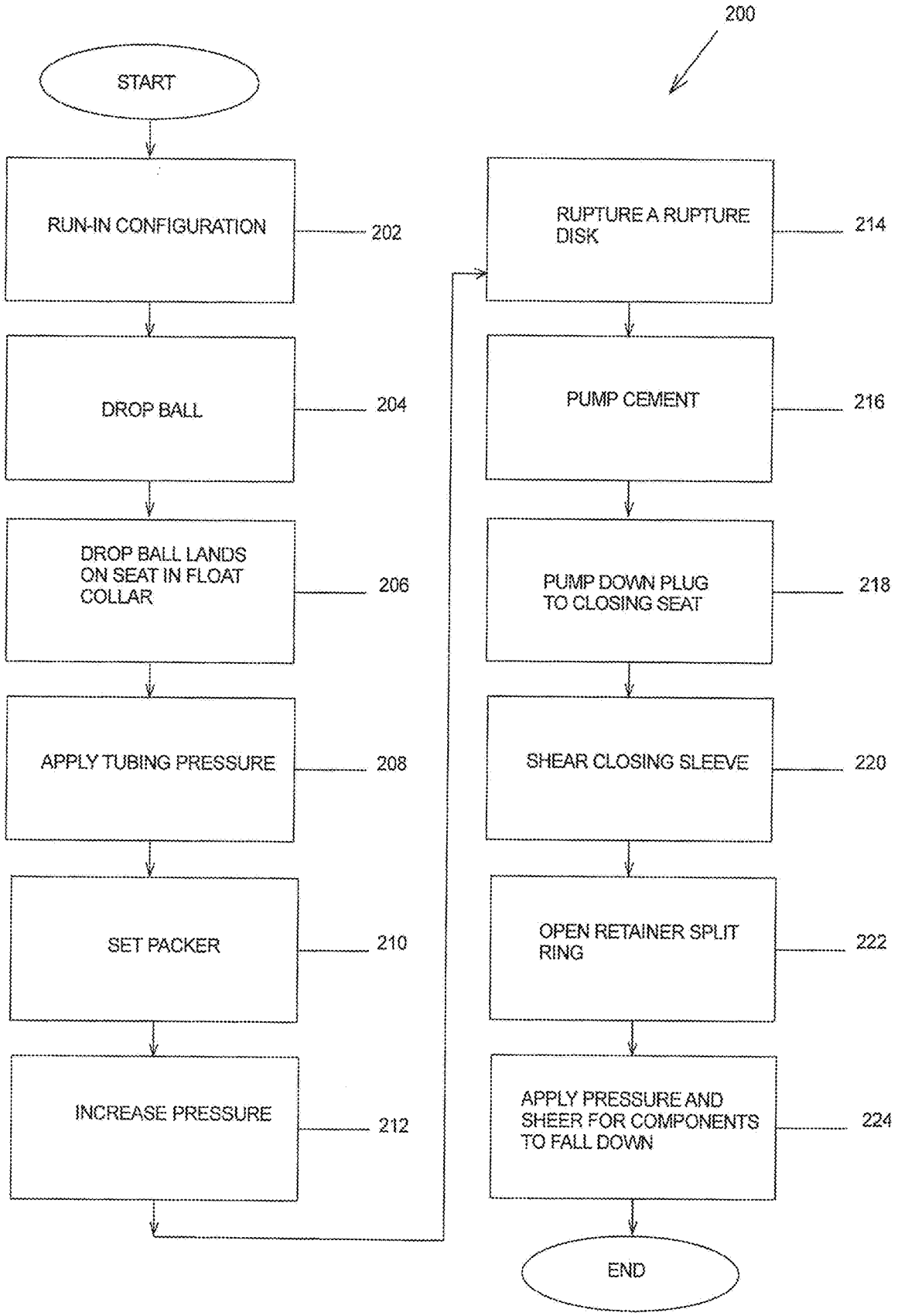
FIG. 2 is a method of performing a cementing operation in a wellbore in one example embodiment of the disclosure.

Referring to FIG. 2, a method 200 for cementing a wellbore is illustrated. In the illustrated embodiment, at 202 a system configuration is inserted (run-in) to a wellbore to a position where cementing is to occur. In this instance, the cementing is to occur at a position that is "off bottom" in a wellbore. Such cementing occurring at a position other than the bottom of a well may occur where a hydrocarbon rich zone occurs at an elevation other than the bottom of a well. Once the system has been inserted to the correct depth, at 204, a ball is dropped inside the tool. The ball descends through the tool, through gravity, until the dropped ball lands on the seat of a float collar at 206. As will be understood the dropped ball is sized to seat directly on the float collar seat and allow for a fluid flow blockage. Once the dropped ball is blocking fluid flow, pressure is increased within the tool at 208. The pressure is increased to a point where a packer is inflated and set, at 210, to block fluid flow in the annulus area around the system inserted into the wellbore. Pressure is further increased, at 212, to a point where a rupture disk bursting pressure is exceeded and the rupture disk within the tool is ruptured at 214. At this point, the rupture disk rupture provides a pathway for cement to be pumped down the wellbore and out to the annulus area. After a pre-described amount of cement is pumped downhole at 216, a plug is inserted into the wellbore to push out the remainder of the cement at 218. The plug may be a standard wiper plug to clean the inside of the annulus and setting tool. The plug may eventually settle in a closing seat. At 220, the closing sleeve shears shifting the closing sleeve down and closing the tool. At 222, the retainer split ring which holds the closing seat in place pops open when the ring shifts into a respective groove releasing the closing sleeve and locking the closing sleeve into place. The closing seat/closing plug free fall down to the float collar. At 224, pressure is further applied to the system and the float collar shears out using the same mechanism as the stage tool. All of the unsupported components fall downhole to the shoe track.

Figure 3:
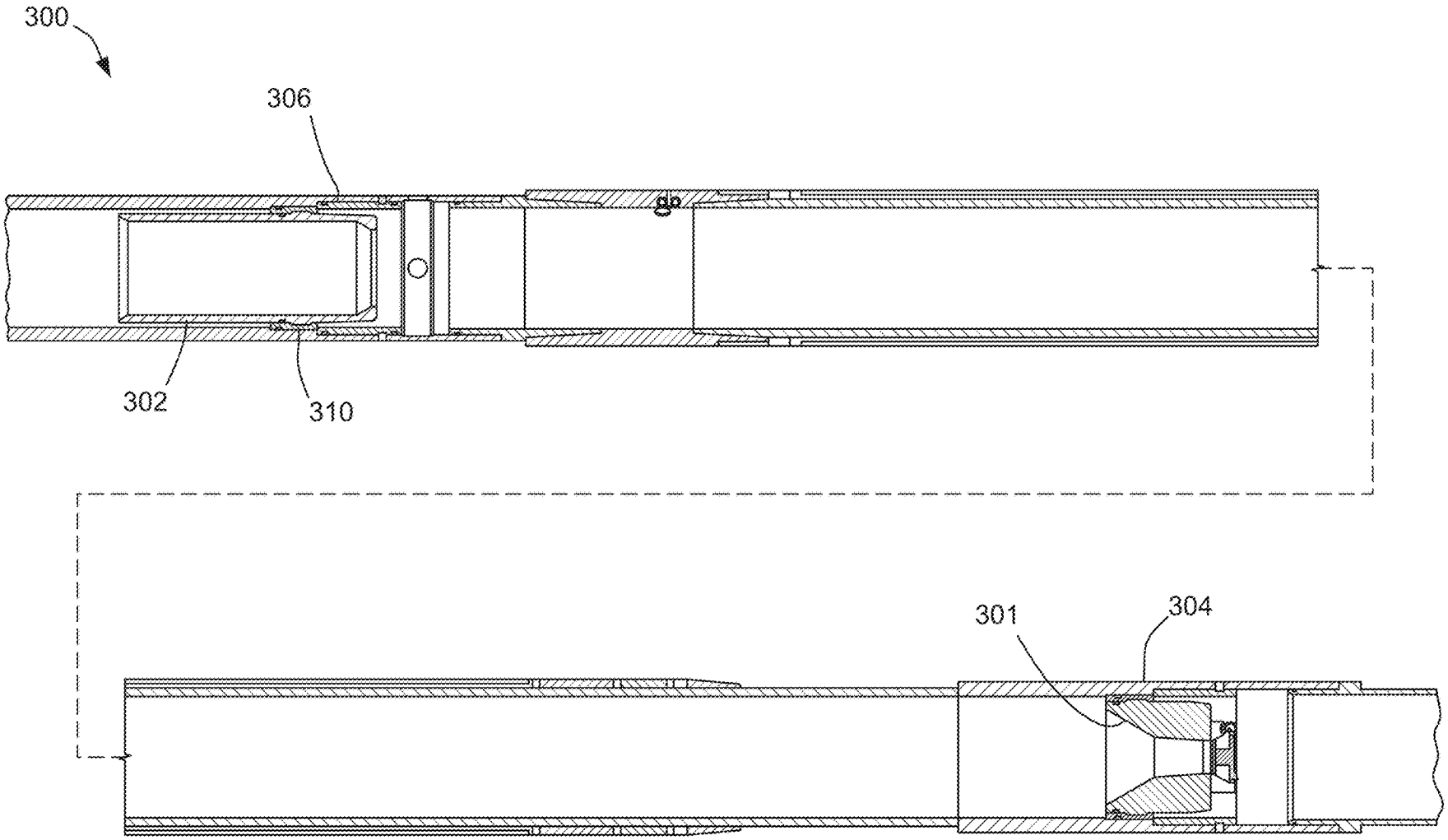
FIG. 3 is a side cross-sectional view of an apparatus to conduct cementing operations in one example embodiment of the disclosure.
Figure 10:
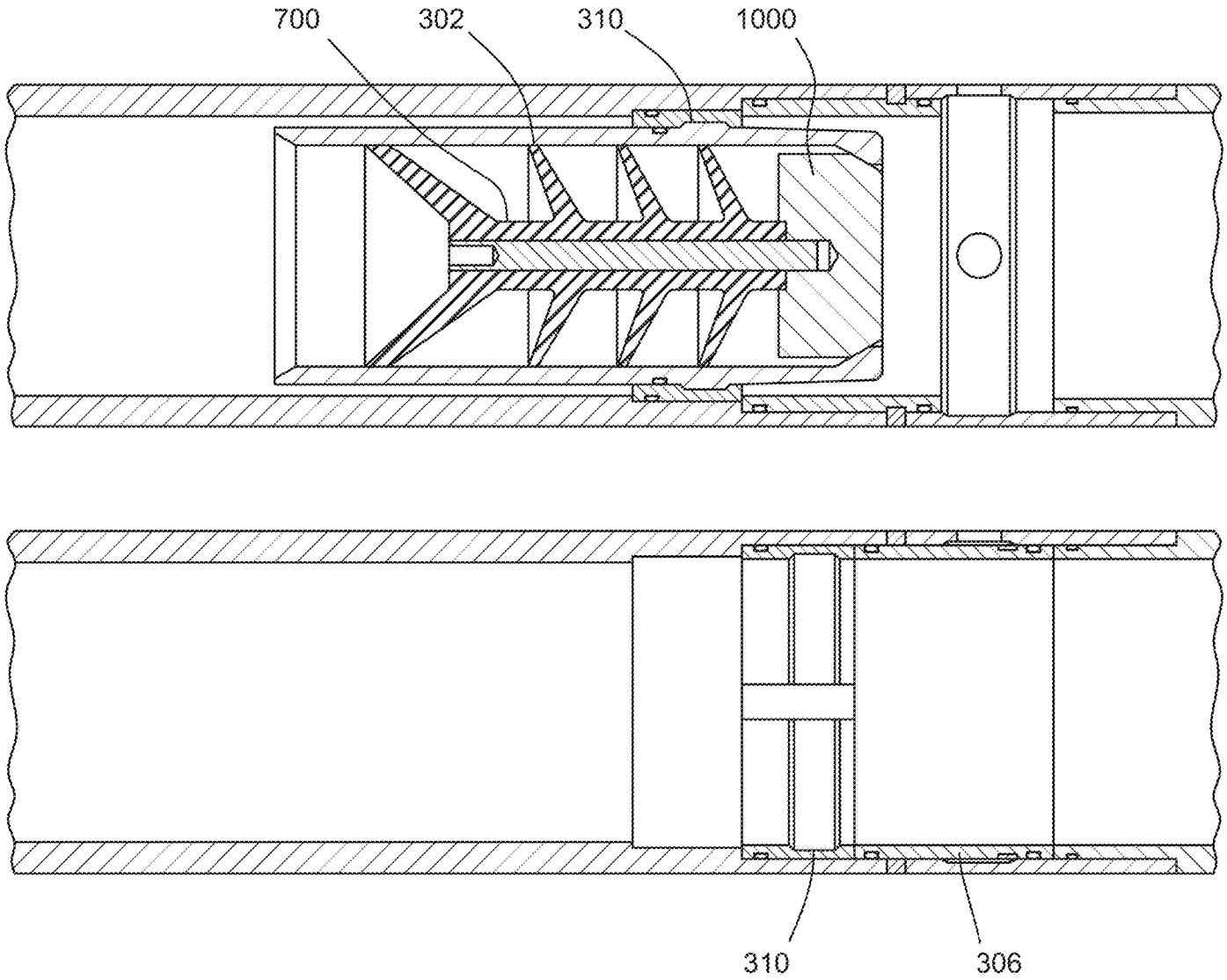
FIG. 10 is an expanded cross-sectional view of the wiper plug captured by the float collar of FIG. 8, illustrating the capturing components of the float collar.

Detailed figures are presented for each of these steps. Referring to FIG. 3, a cross-sectional view of the apparatus 300 is illustrated. In this view, a constriction is present at the right most portion of the apparatus 300 that acts as a seat 301 in a float collar 304. A closing sleeve 306 surrounds the closing seat 302. A split ring 310 is located between the closing sleeve 306 and the closing seat 302. Further expanded details of the lower portion of the apparatus 300 are shown in FIG.10 and explained below. The split ring 310 may be placed in a groove in the interior volume of the apparatus. The apparatus 300 has a body that defines an interior volume into which the seat 302 is placed. The interior volume may be used to transport materials down the drill string, such as fluids including water, drilling mud and cement mixtures. The closing sleeve 306 is configured to extend from an open position to a closed position, wherein in the closed position, the closing sleeve defines a barrier between the interior volume of the apparatus and an annulus of the wellbore.

Figure 4:
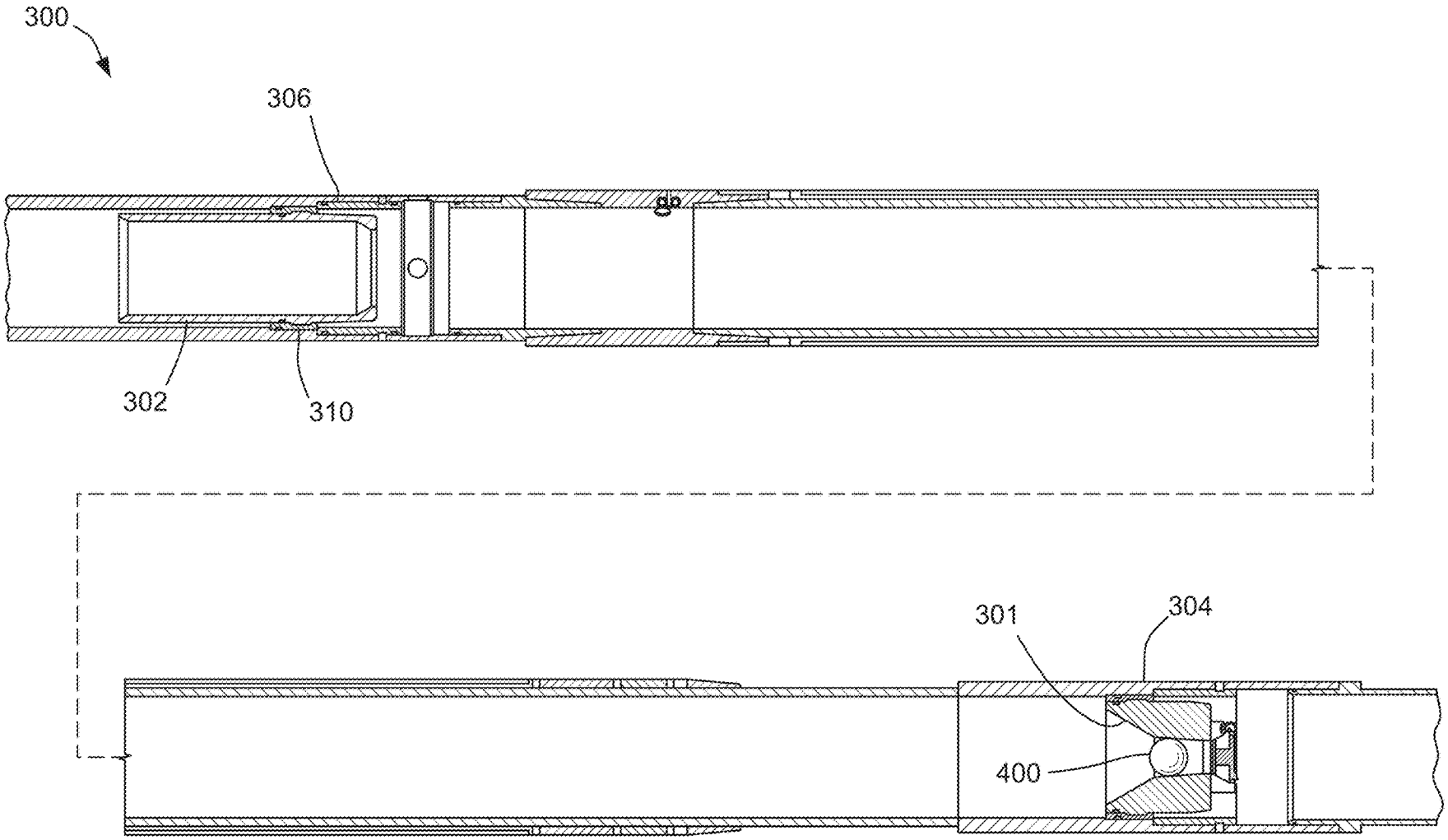
FIG. 4 is a side cross-sectional view of the apparatus of FIG. 3 with a dropped ball in one example embodiment of the disclosure.

Referring to FIG. 4, a ball 400 is dropped down the apparatus 300 and through gravity lands on the seat 301 the float collar 304. As the configuration of the apparatus 300 is such that fluid flows through the float collar 304, closure of the float collar 304 with the ball 400 causes a fluid obstruction within the apparatus. This obstruction is a complete obstruction and the pressure in the apparatus 300 builds after seating of the ball 400.

Figure 5:
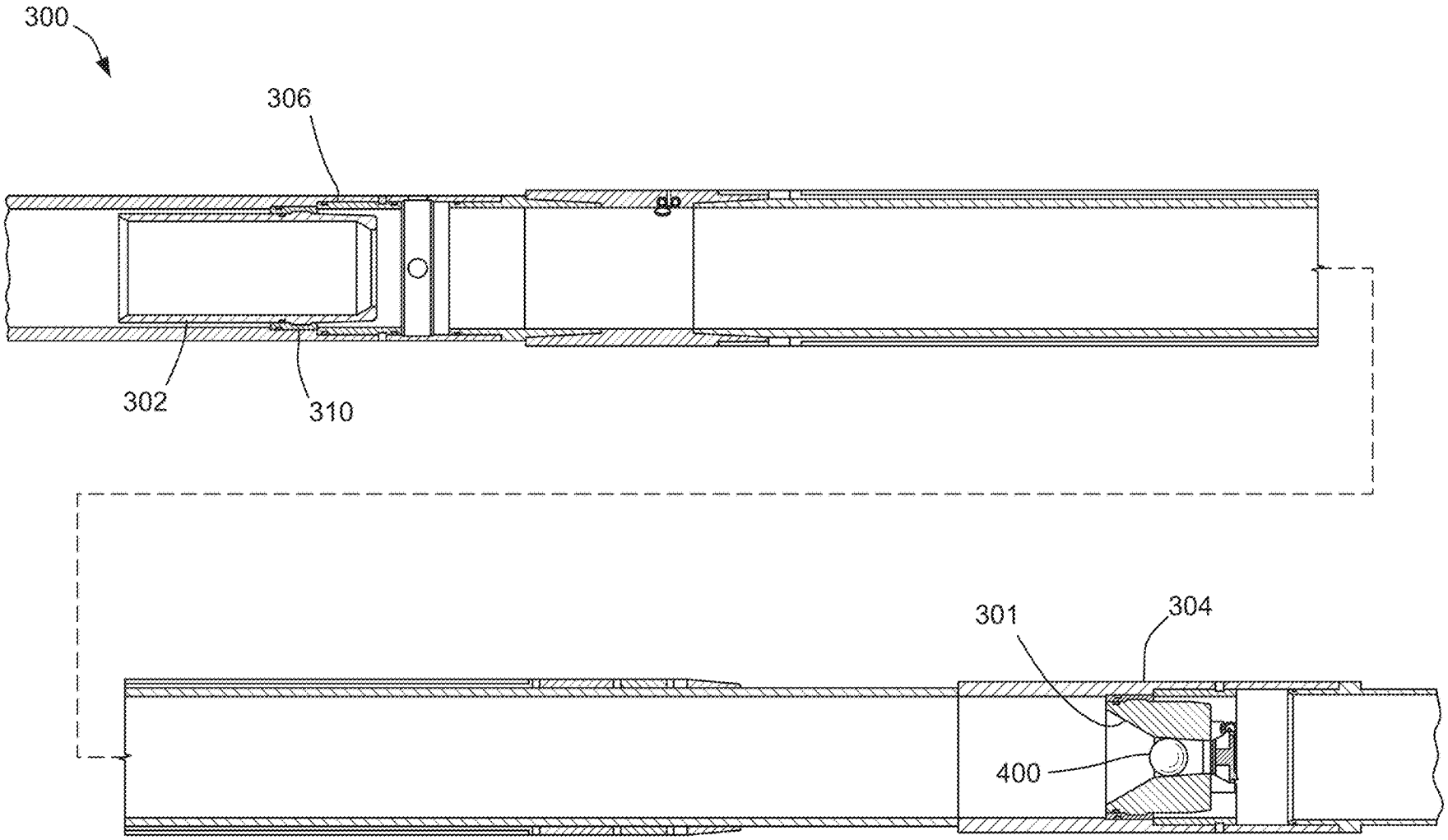
FIG. 5 is a side cross-sectional view of the apparatus of FIG. 4 during packer inflation in one example embodiment of the disclosure.

After the increase in pressure starts, a packer (unshown), is deployed in between the annulus of the wellbore and the outside of the apparatus 300. The purpose of the packer is to eliminate and cement from flowing back up through the hole in an area where the cement is not required. Thus, at the inflation of the packer, a zone is isolated for cementing to begin. As will be understood, a lower packer may also be deployed, as needed, to limit travel of the cement to elevations below the apparatus 300. Pressure inside the apparatus 300 is increased such that after a predetermined pressure level, a rupture disk on the inside of the apparatus 300 bursts, which opens the stage tool for flowing of cement. Such a configuration is illustrated in FIG. 5.

Figure 6:
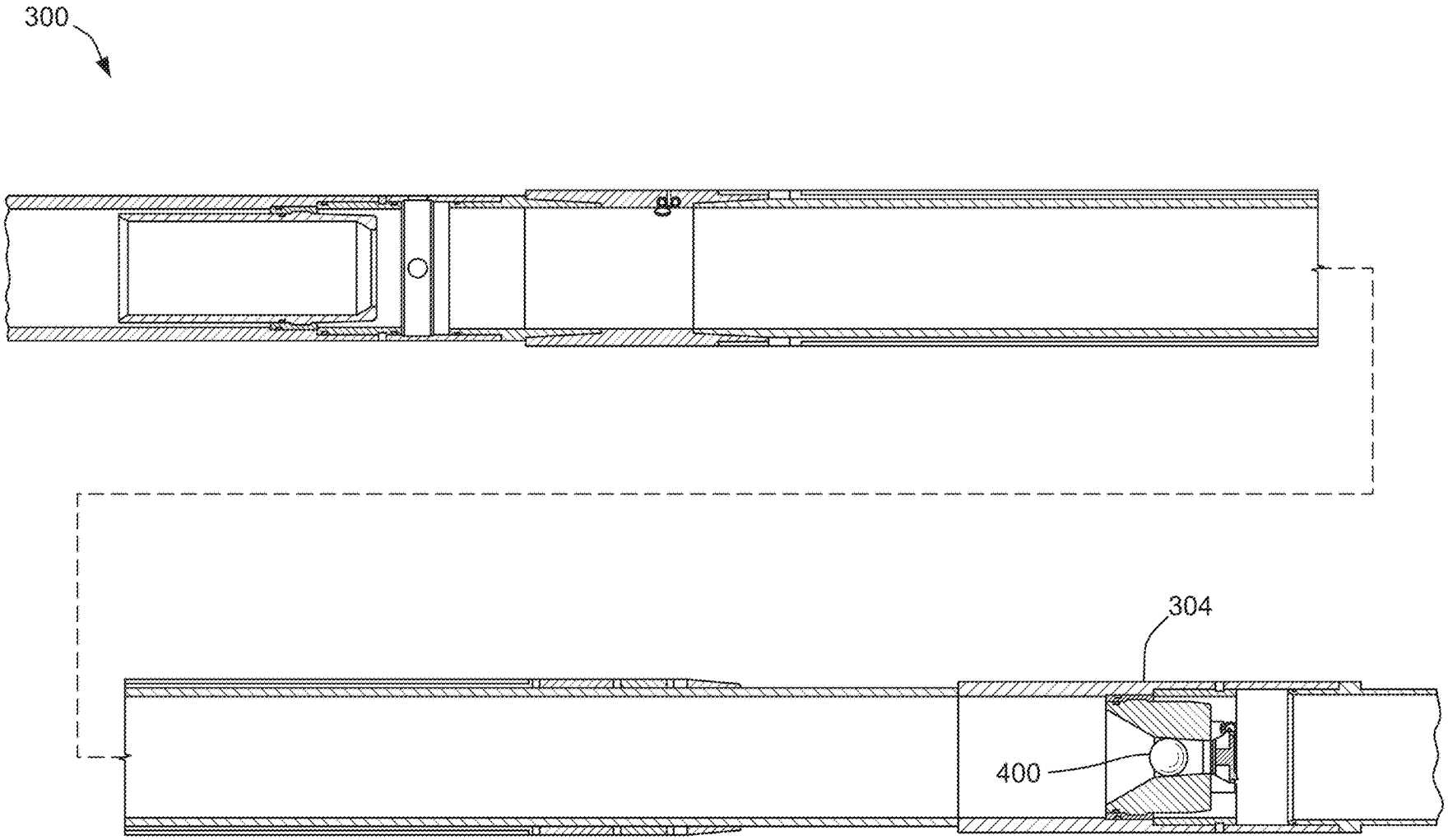
FIG. 6 is a side cross-sectional view of the apparatus of FIG. 5 during cement pumping operations in one example embodiment of the disclosure.
Figure 7:
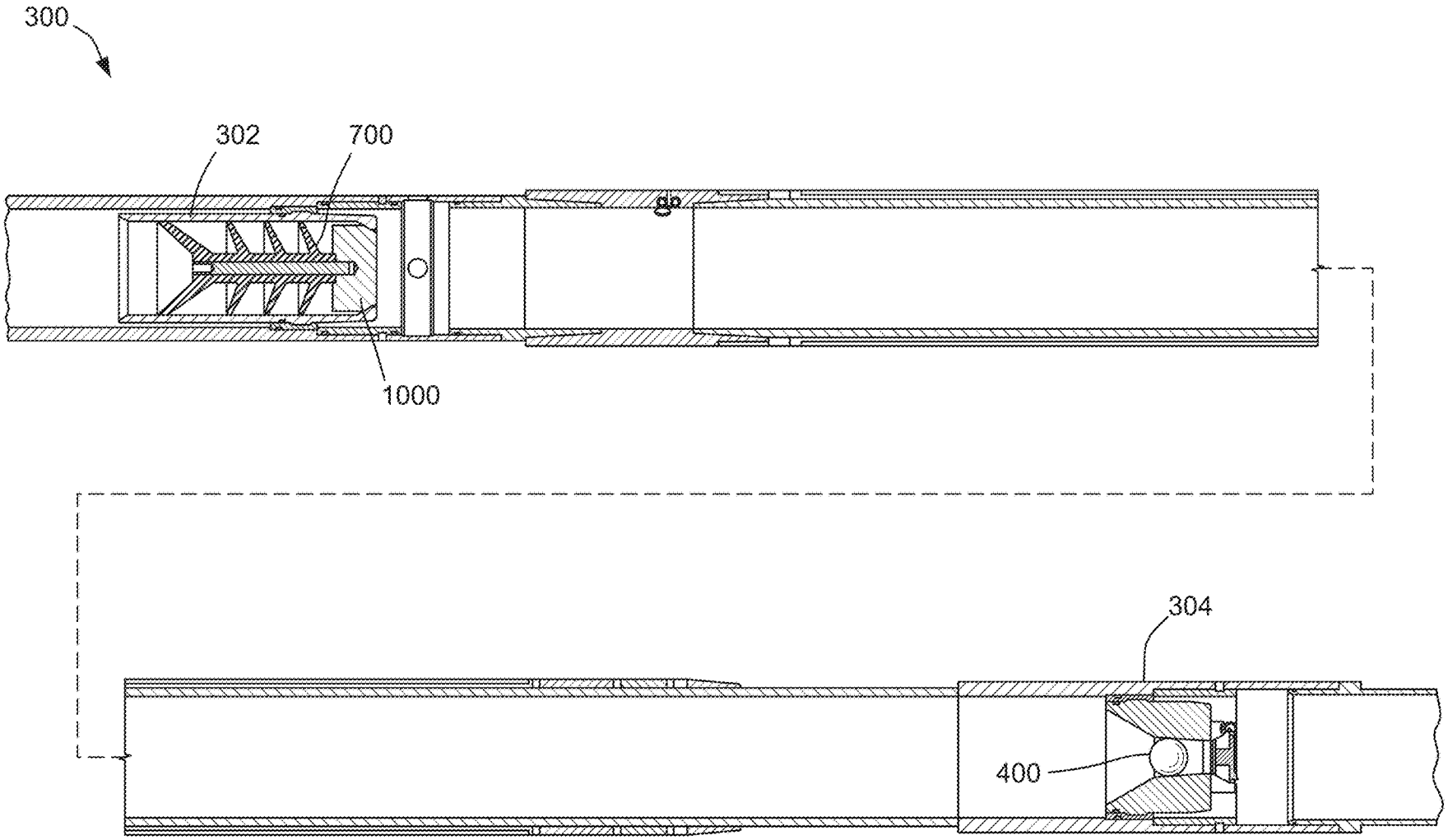
FIG. 7 is a side cross-sectional view of the apparatus of FIG. 6 with a wiper plug inserted into the apparatus in one example embodiment of the disclosure.

Referring to FIG. 6, the configuration of the apparatus 300 is illustrated ready for flow of cement. Referring to FIG. 7, a cement plug 700 is inserted into the apparatus 300. The cement plug 700 may be a standard wiper plug that has a flexible outside surface to allow for a wiping action and dislodgement of cement as the cement plug 700 travels down the apparatus 300. The cement plug 700 travels down with a plug seat 1000 to the vicinity of the ball 400 where the plug 700 lodges in a closing seat 302 at FIG. 8. At this juncture, the plug 700 is firmly held in place within the closing sleeve 306 thus closing the apparatus 300. A retainer split ring which holds the closing seat 302 in place opens when it shifts from a groove, thereby releasing the closing sleeve 306 and locking the closing sleeve 306 in place. The closing seat 302, plug seat 1000 and plug 700, however, dislodge from the interior of the closing sleeve and fall to the float collar 304.

Figure 9:
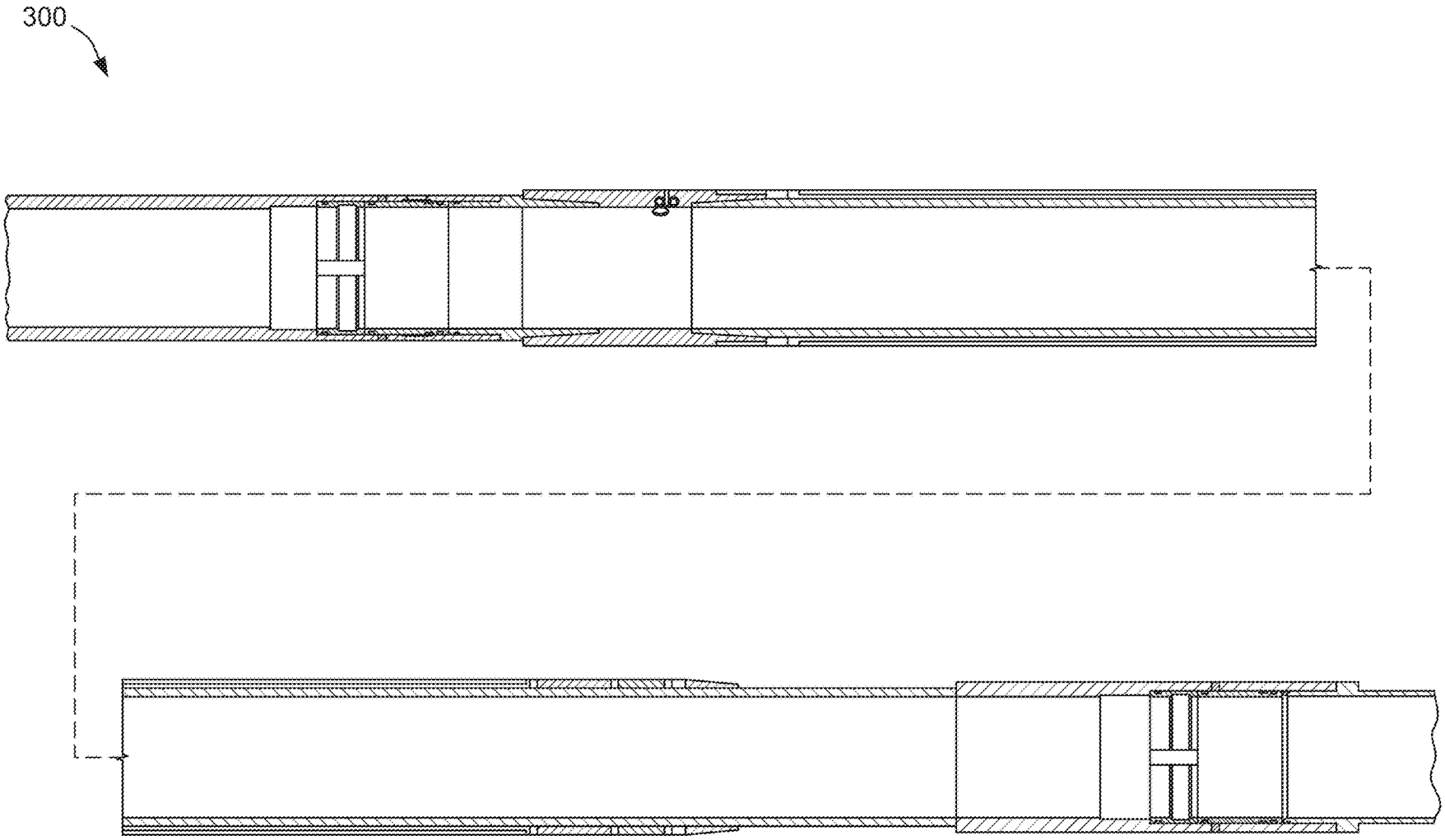
FIG. 9 is a side cross-sectional view of the apparatus of FIG. 8, with the wiper plug dislodged and traveling to the shoe track after pressure increase.

In FIG. 9, further pressure is applied to the interior of the apparatus 300 and the float collar 304 shears away from its supports, and the float collar 304 descends to a shoe track (not shown) at the bottom of the well.

Figure 8:
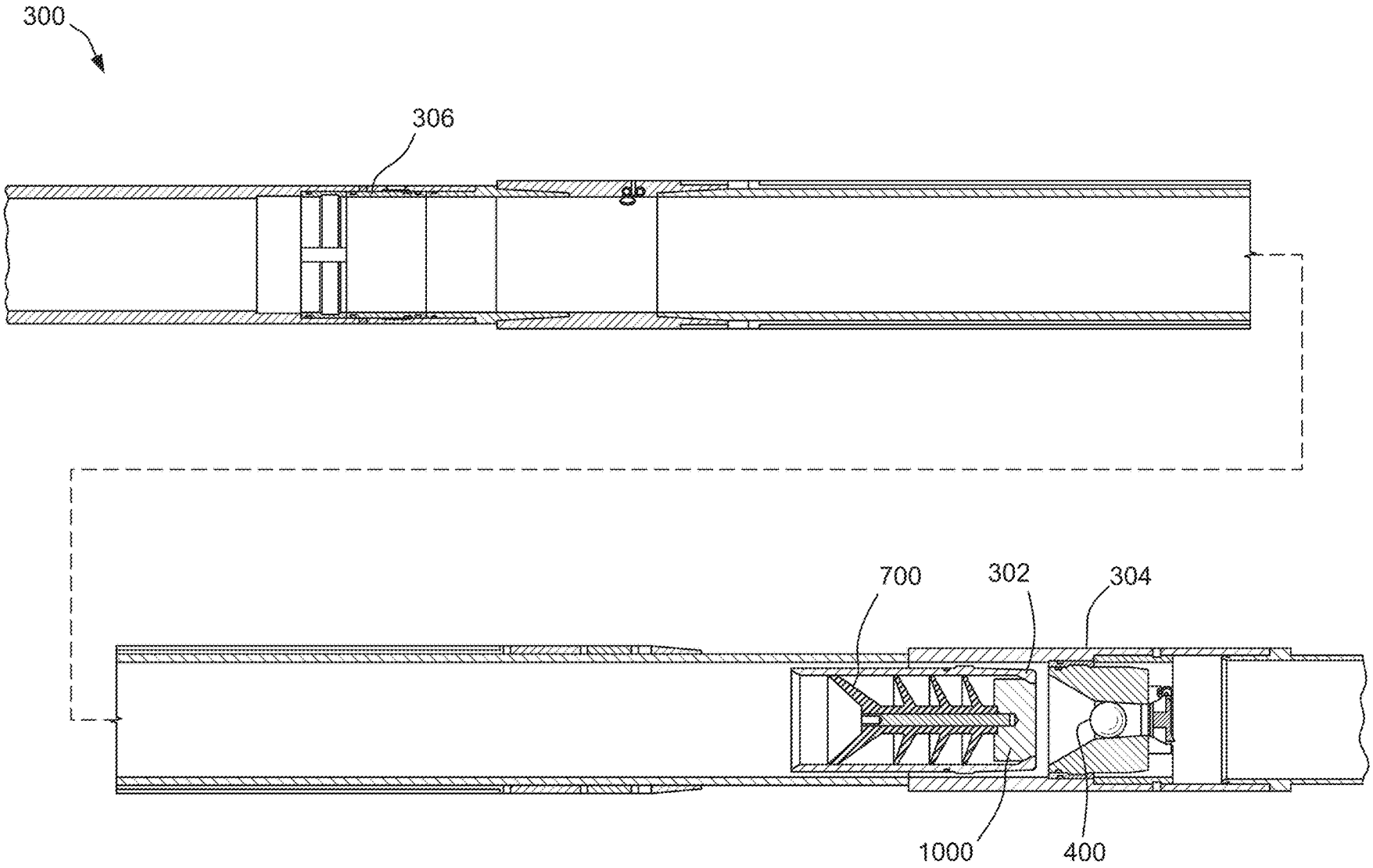
FIG. 8 is a side cross-sectional view of the apparatus of FIG. 7, with the wiper plug captured by the float collar, in one example embodiment of the disclosure.

In FIG. 10, the details of the construction of the apparatus 300 during the configuration in FIG. 8 is provided. In this figure, the float collar 304 retains the plug seat 1000 and plug 700 as illustrated in FIG. 9. As illustrated in FIG. 10, a split ring 310 is compressed and placed within the apparatus 300 such that the closing seat 302 is maintained in place. After forces over a predetermined amount, the split ring 310 releases the plug seat 1000 such that the closing sleeve 306 closes. The plug seat 1000, being unsupported, may dislodge and travel to the bottom of the wellbore.

Figure 11:
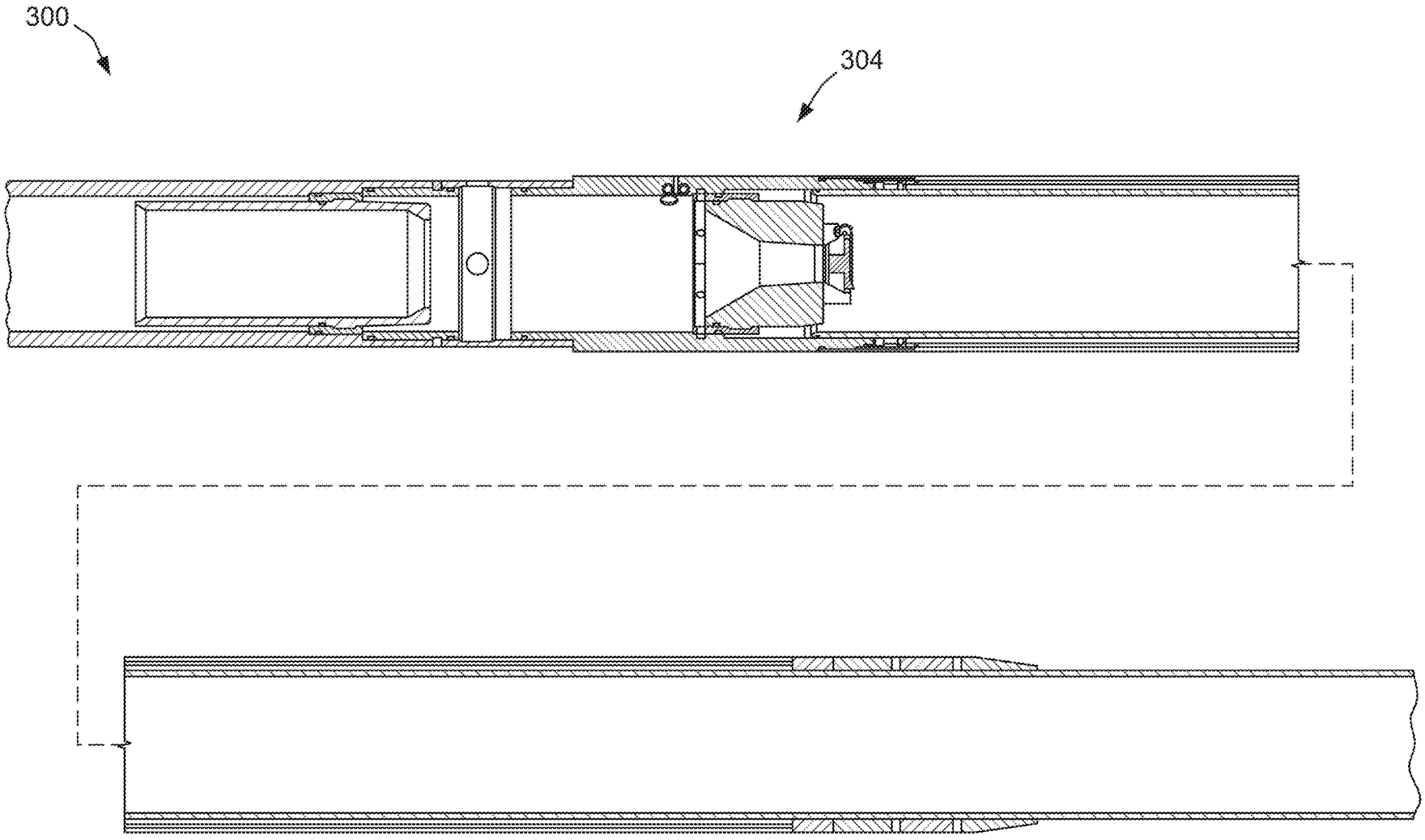
FIG. 11 is an expanded cross-sectional view of float collar after dislodging of the wiper plug seat and wiper plug after traveling to the shoe track.

FIG. 11 illustrates the float collar 304 after separation of the seat 302 and the wiper plug 700 (see FIG. 9) from the remaining internals of the apparatus 300. As can be seen in this configuration, the plug 700 and the seat 302 are no longer at the float collar 304 and have travelled to the shoe of the wellbore.

Figure 12:
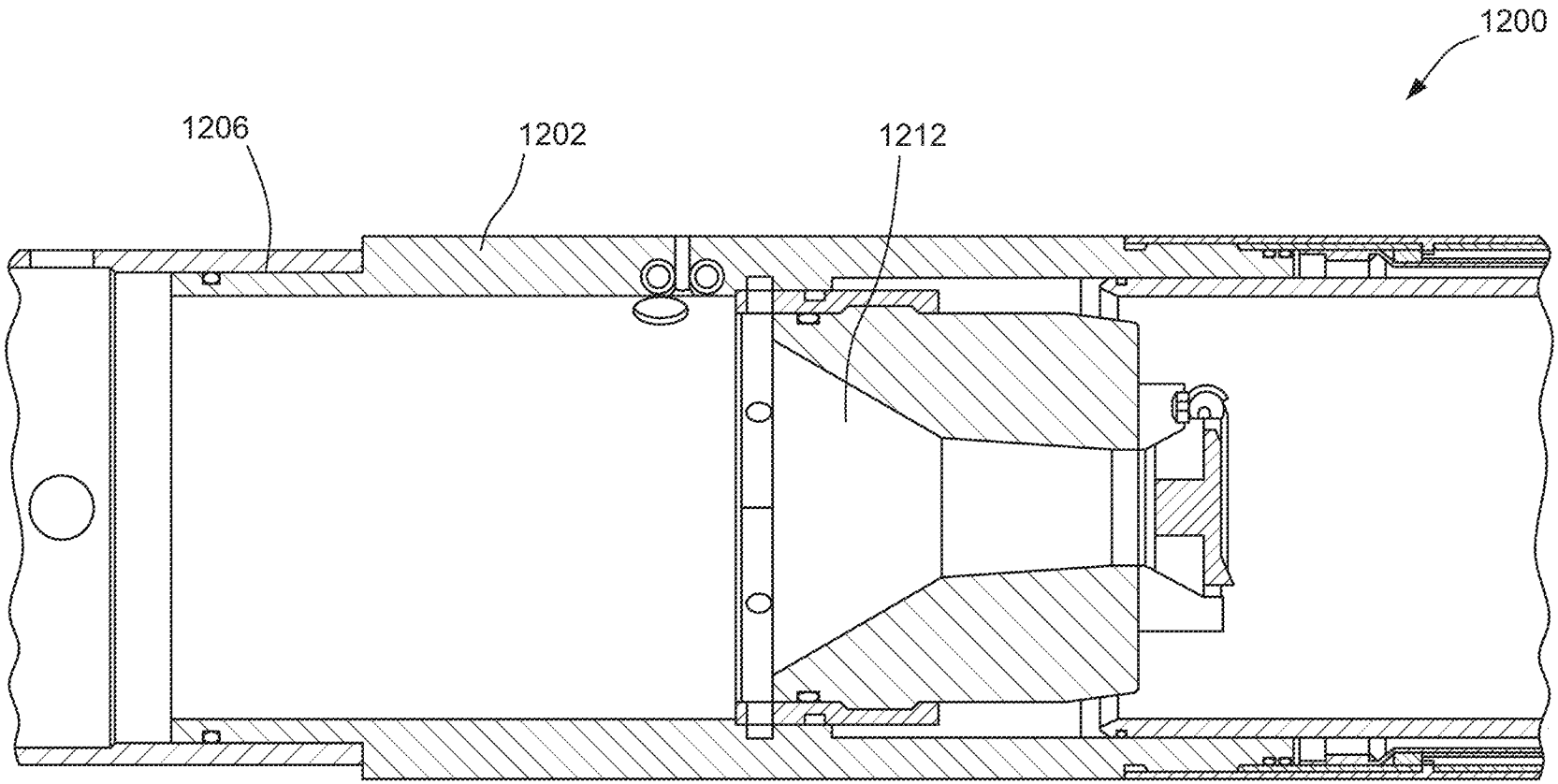
FIG. 12 is a second embodiment of a system for cementing in accordance with another example embodiment of the disclosure.

Referring to FIG. 12, a second embodiment of the disclosure is presented. This embodiment may be used in configurations that are relatively compact compared to the apparatus disclosed in FIG. 3. FIG. 12 illustrates a side cross-section of a system 1200 that may be used in a number of other configurations or situations. The system 1200 has less moving parts than the apparatus 300 described above. In this embodiment, a single moving sleeve 1210 is provided. As illustrated, the valve seat 1212 is located before dislodgement. In this embodiment, as described above, the same sequence followed above may be followed, however, a float valve is mounted inside the inflatable casing packer 1202. The inflatable casing packer 1202 and the stage tool 1204 directly engage one another through a threaded connection 1206.

Figure 13:
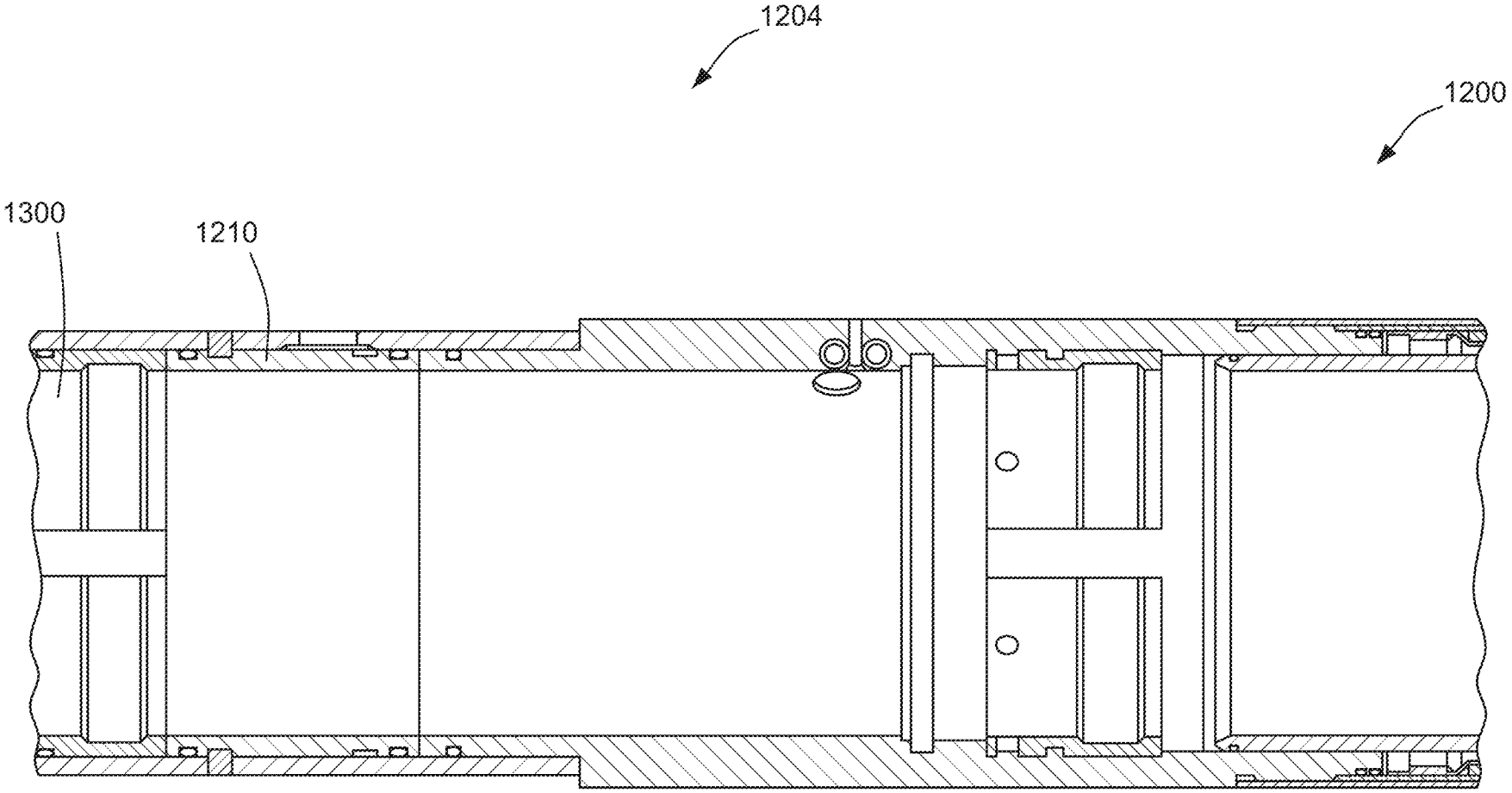
FIG. 13 is an exploded view of the second embodiment of the system of FIG. 12, showing the ball seat and surrounding components.
Figure 14:
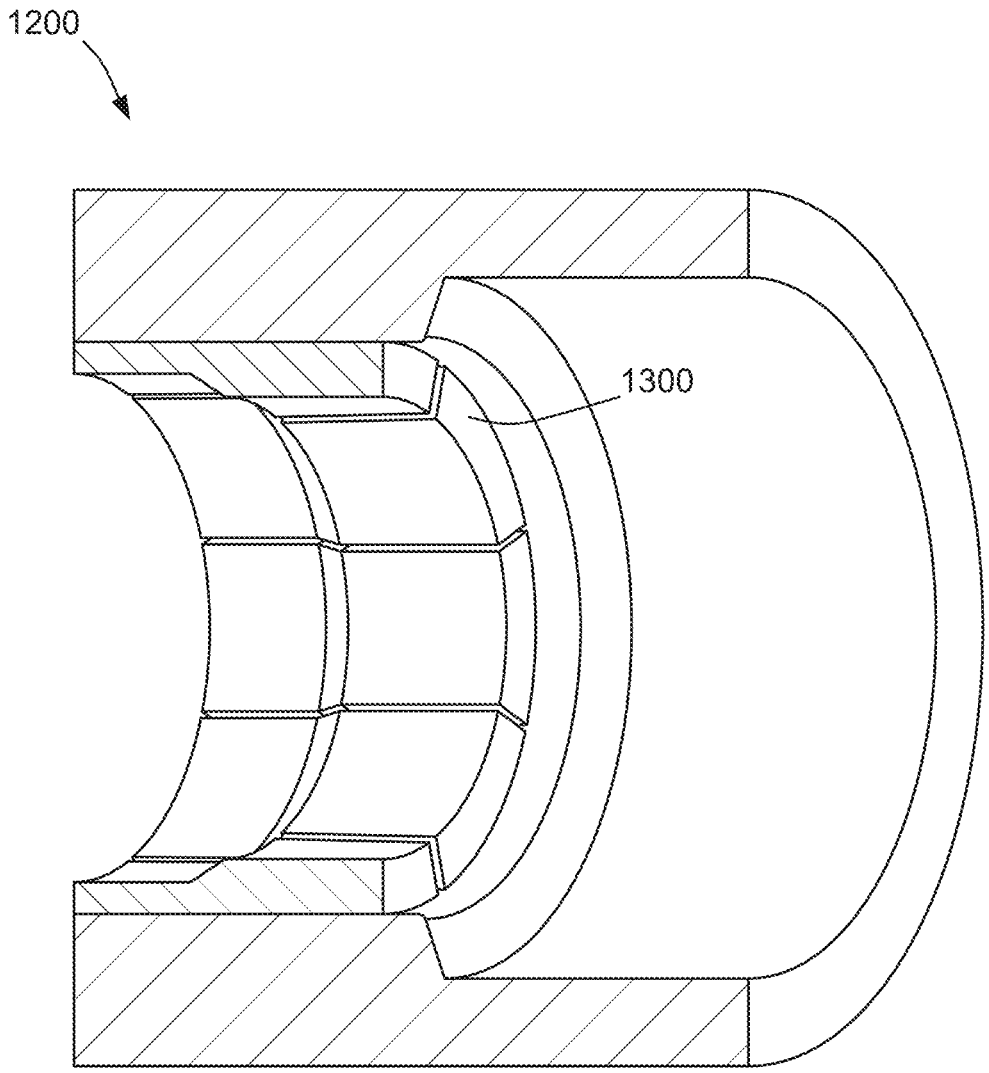
FIG. 14 is an exploded view of the second embodiment of the system of FIG. 12, wherein components are directly threaded together, eliminating a need for a thread sub.

Referring to FIG. 13, the valve seat 1212 and associated support configuration is expanded. As is illustrated, a tang arrangement 1300 is provided such that when an expected pressure is reached, the system 1200 actuated such that a slide closes the system and the outside sleeve is retained by the tang arrangement 1300 while the valve seat 1212 dislodges and falls to the shoe of the wellbore arrangement. Referring to FIG. 14, the slide of the system 1200 is closed and the tang arrangement 1300 is engaged to the sleeve.

Figure 15:
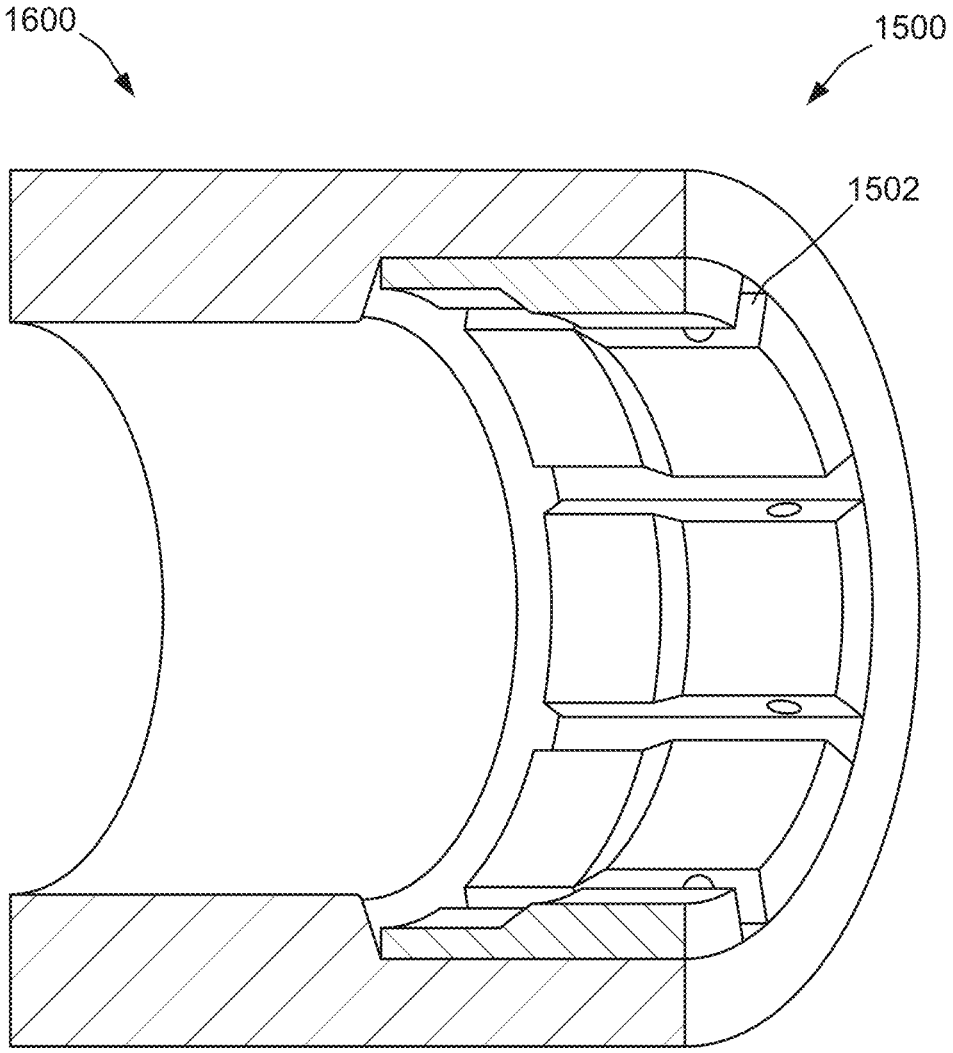
FIG. 15 is a cross-sectional view of a valve seat in one example embodiment illustrating a compressed valve seat spring in one example embodiment of the disclosure.
Figure 16:
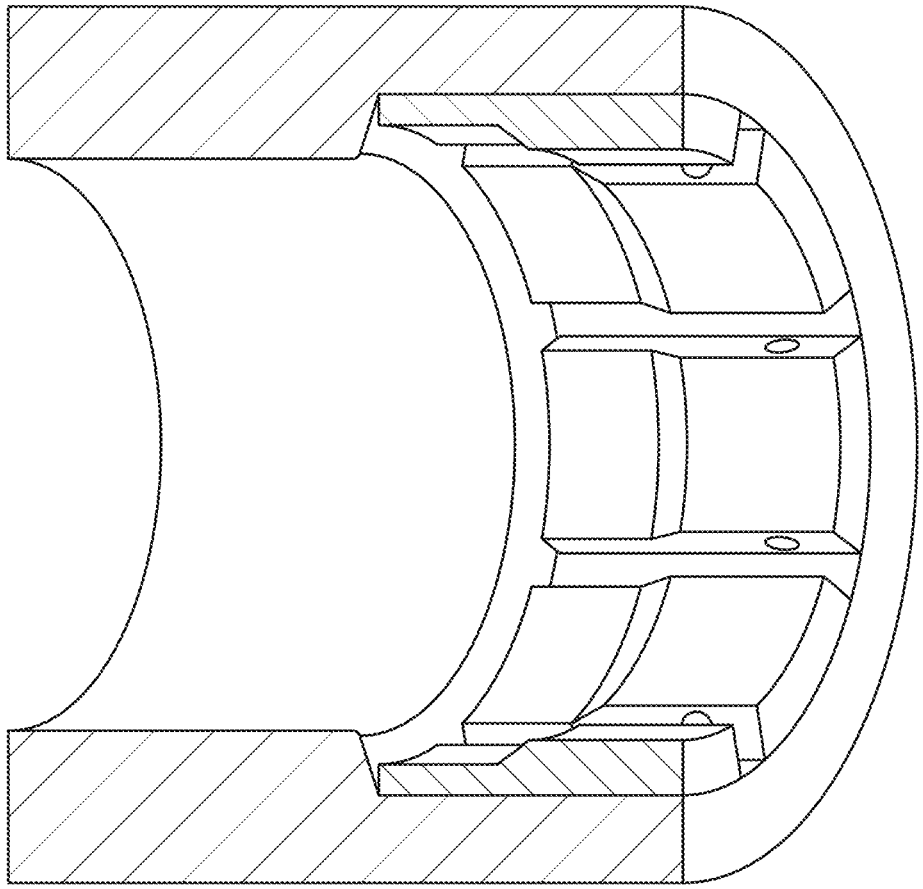
FIG. 16 is a cross-sectional view of the valve seat of FIG. 15, with the valve seat spring expanded on one example embodiment of the disclosure.

Referring to FIG. 15, an alternative seat design 1500 for either the system 1200 or the arrangement 1300 is provided. The alternative seat design 1500 provides a spring 1502 that moves from a first configuration to a second configuration. Such movement is illustrated in the differences between FIG. 15 and FIG. 16, wherein the spring 1502 is compressed in the relatively tighter radial inner dimension in FIG. 15, to the relatively greater radially inner dimension 1600. As can be seen, the spring 1502 is locked in place when in the greater radially inner dimension 1600 by the sliding sleeve.

Figure 17:
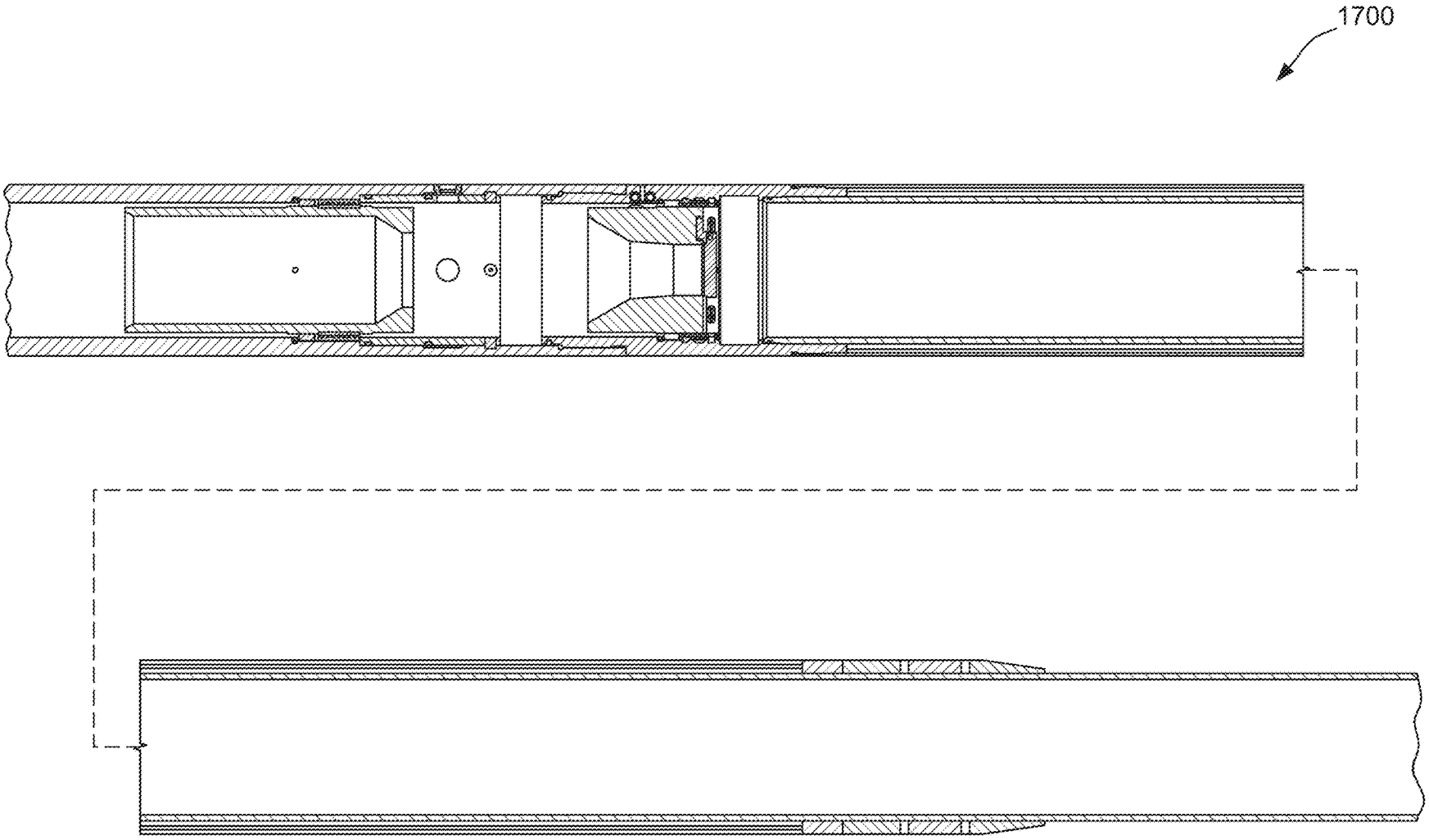
FIG. 17 is a cross-sectional view of a run-in configuration of another embodiment of the disclosure.

Referring to FIG. 17, another example embodiment of the disclosure is presented. The tool 1700 is illustrated in a "run-in" configuration, wherein the wellbore had been drilled into a subterranean formation. This configuration is presented before any actuation of components is accomplished.

Figure 18:
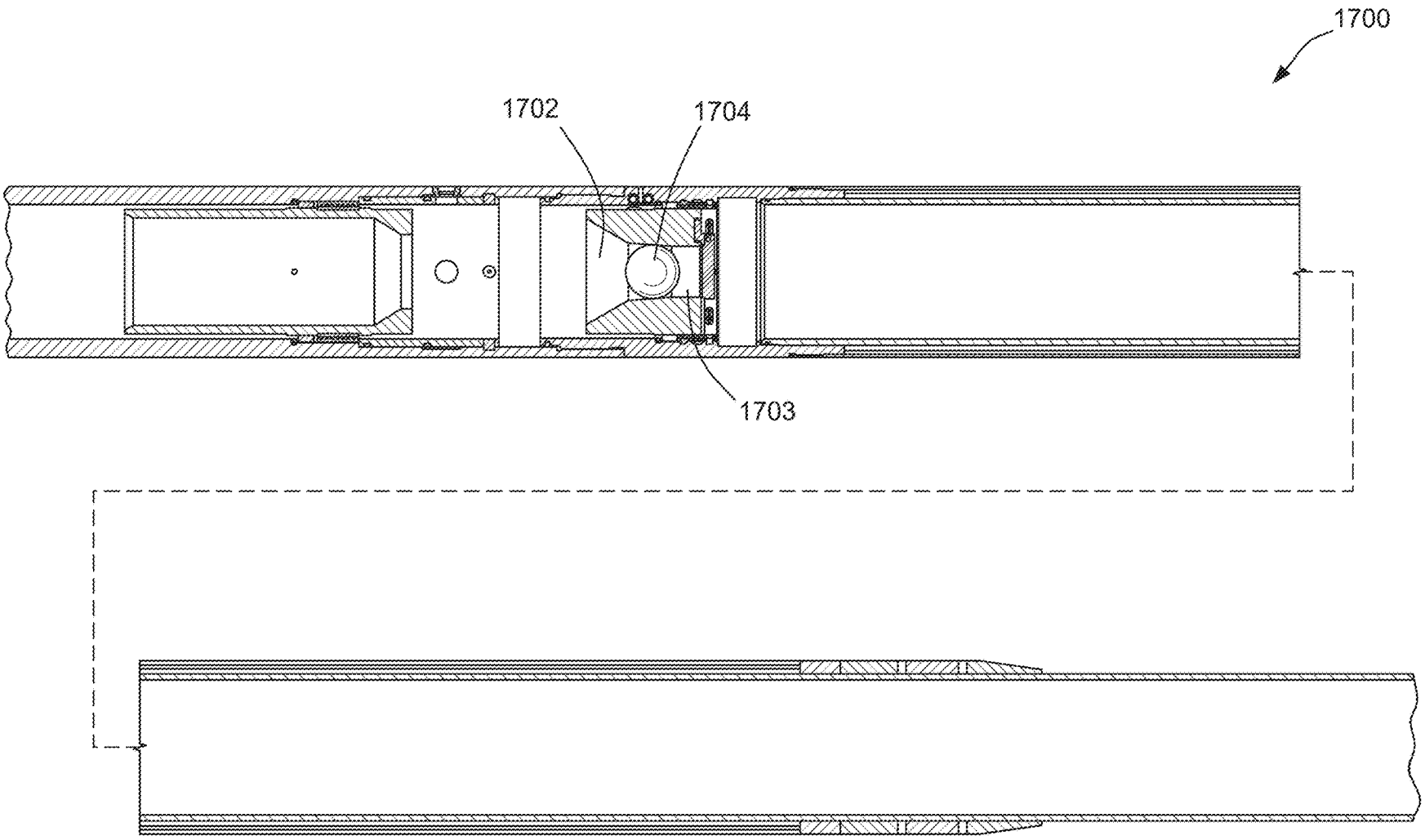
FIG. 18 is a cross-sectional view of a drop ball landing in a ball seal in a float collar of the embodiment of FIG. 17.

Referring to FIG. 18, a first actuation is accomplished, wherein a ball 1704 is dropped and enters the tool 1700 and passes partly through a float collar 1702. A ball seat 1703 is presented in the form of a cone wherein the dimensions of the cone are smaller than the dimensions of the ball 1704. The ball 1704 passes down the tool 1700 to the float collar 1702 and ball seat through gravity. The ball 1704 may also pass down through an increase in pressure of the fluid within the tool 1700.

Figure 19:
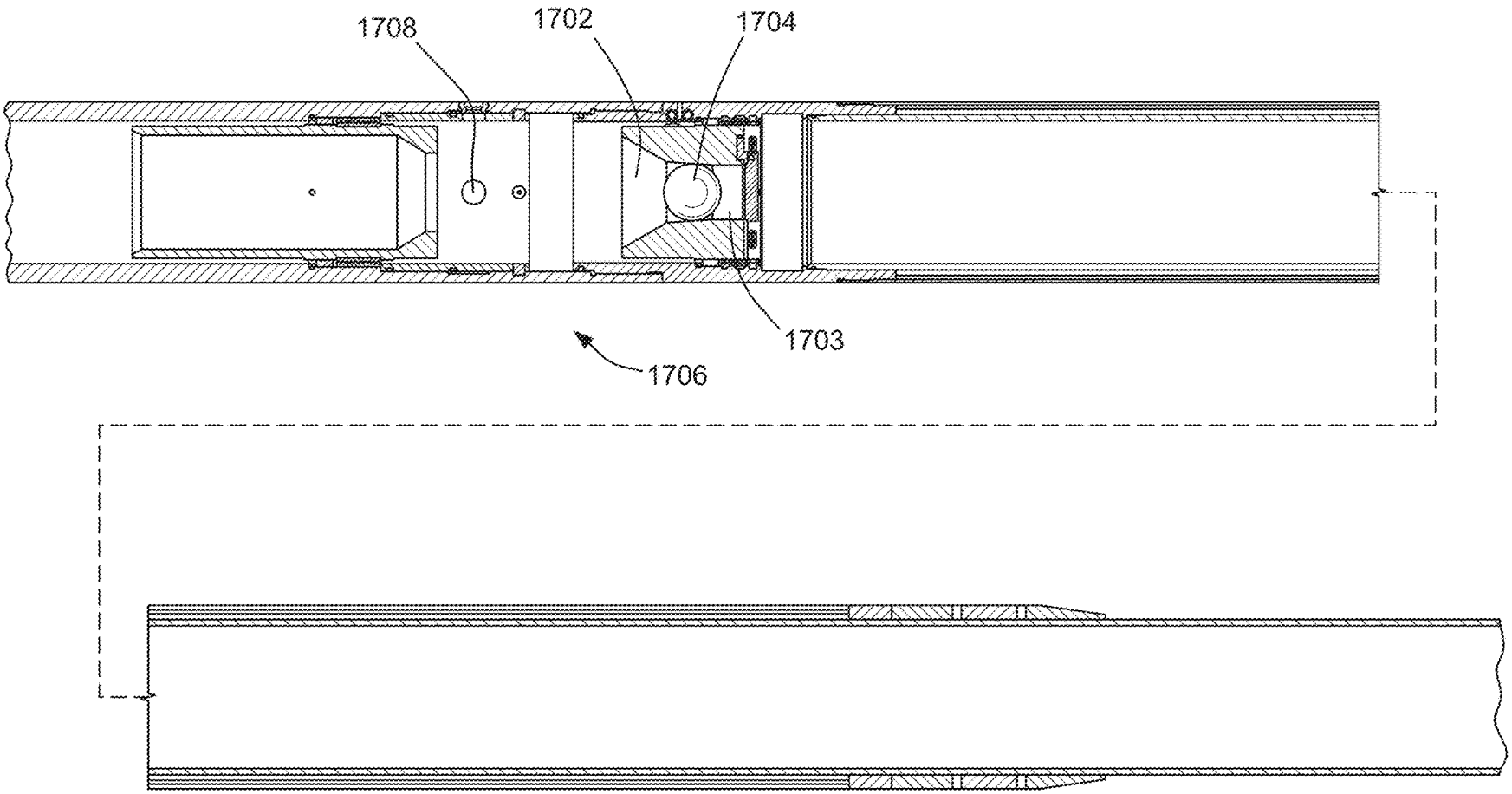
FIG. 19 is a cross-sectional view of a configuration wherein tubing pressure is applied which sets a packer until a rupture disk in the stage tool opens.

Referring to FIG. 19, the configuration of FIG. 17 is illustrated wherein the ball 1704 is positioned approximately half way through the float collar 1702 lodged into the ball seat 1703. Tubing pressure is applied and the pressure sets a packer while pressure is then increased until a rupture disk 1708 in the stage tool 1706 opens.

Figure 20:
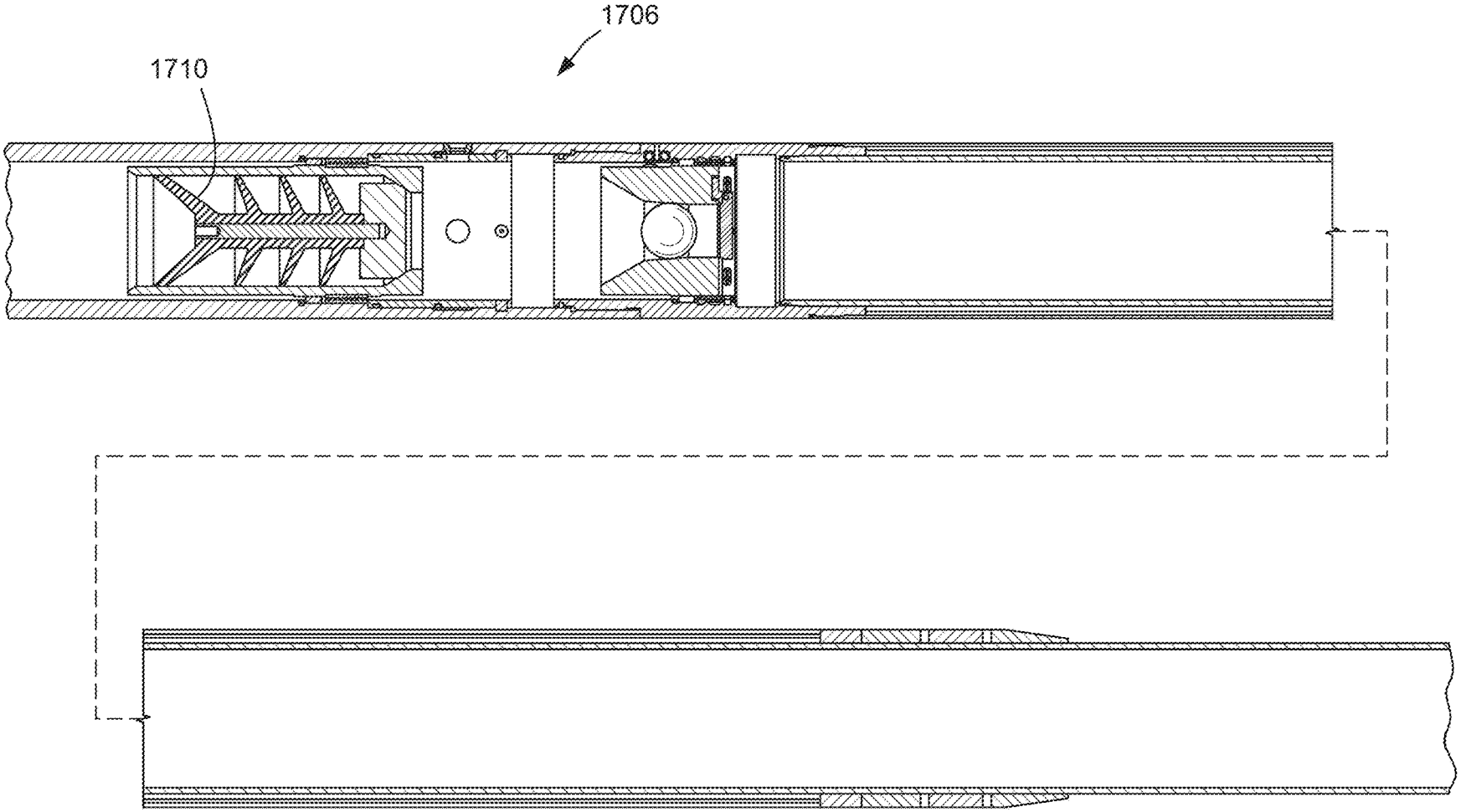
FIG. 20 is a cross-sectional view of a configuration wherein cement is pumped through the stage tool, followed by a closing plug.

Referring to FIG. 20, the configuration of FIG. 19 continues wherein cement is pumped through the stage tool 1706 followed by a closure plug 1710. The plug 1710 may be a standard "wiper" plug used to push cement as the plug 1710 is forced downhole.

Figure 21:
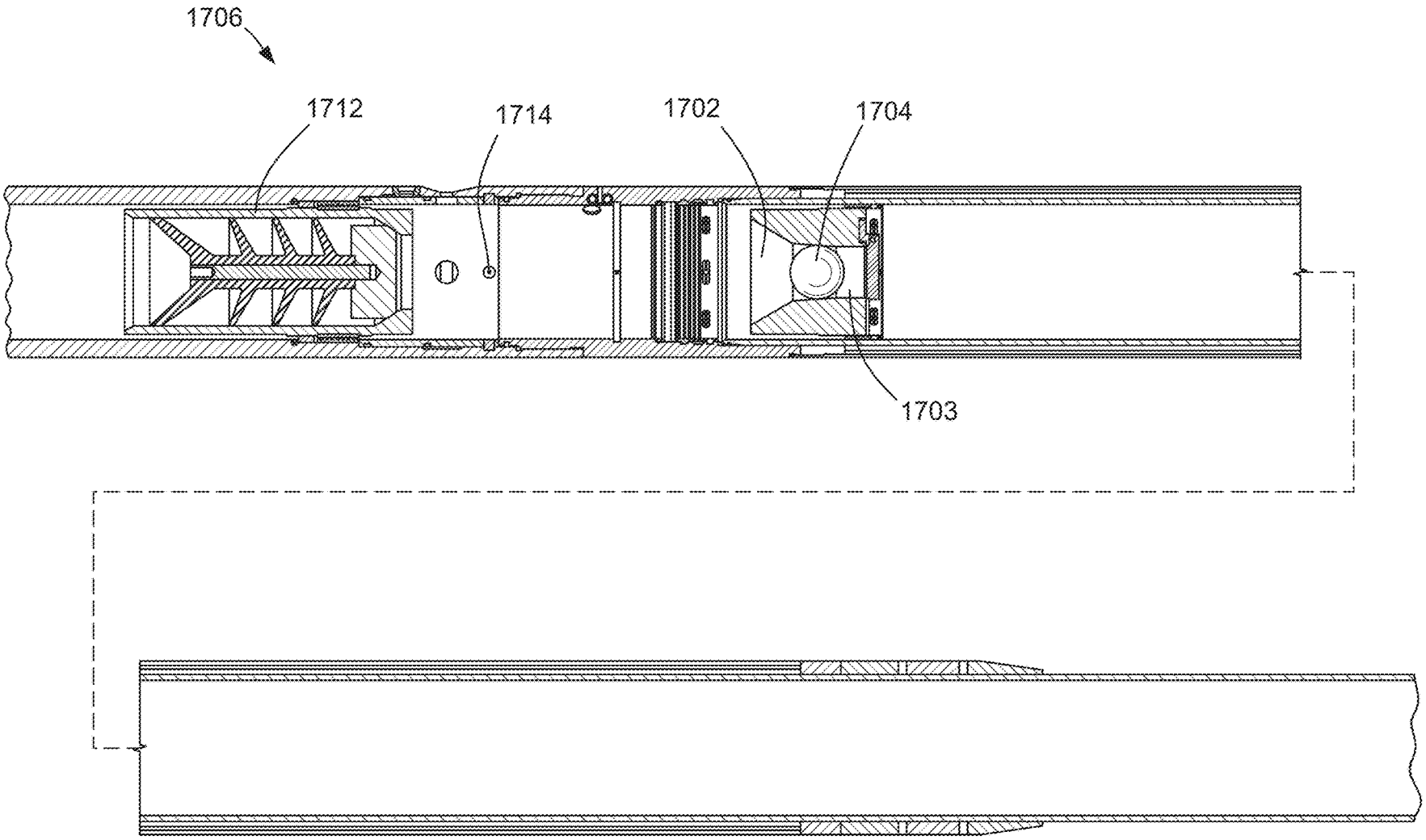
FIG. 21 is a cross-sectional view of the configuration of FIG. 17, wherein a closing plug has landed on a closing seat.

Referring to FIG. 21, the configuration of FIG. 20 is advanced in time wherein the plug 1710 lands on a closing seat 1712. As can be seen, the ball 1704 is also in contact with the ball seat 1703, preventing flow through the float collar 1702. As pressure is increased on the left side of the drawing, increased pressure is exerted on closing sleeve shear screws 1714, wherein shearing of the screws 1714 is accomplished and subsequent closing of the stage tool 1706.

Figure 22:
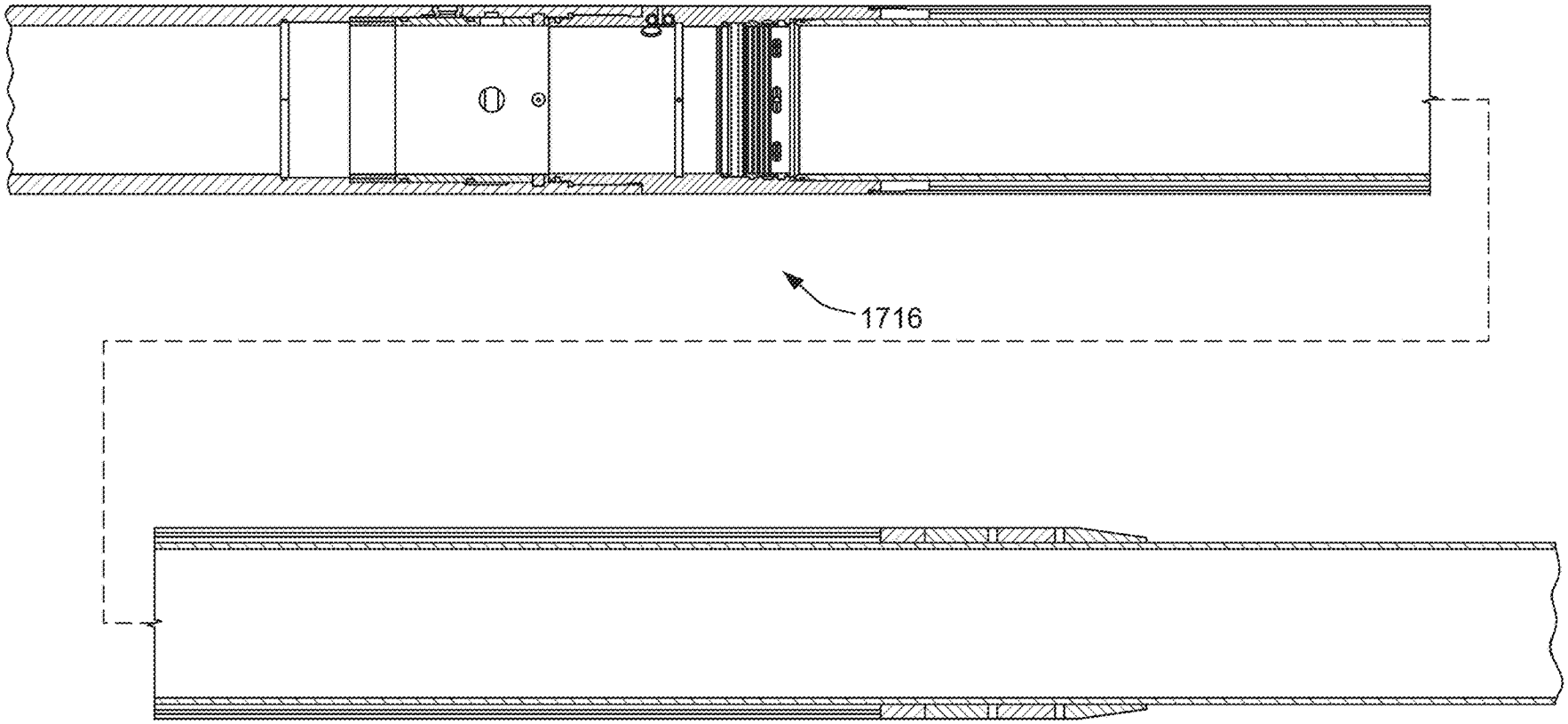
FIG. 22 is a cross-sectional view of the configuration of FIG. 17, wherein internal components have fallen down the well.

Referring to FIG. 22, the configuration of FIG. 21 is advanced in time wherein the pressure is further increased and float collar sheer screws 1716 are sheared and the ball seat 1703 is released and the internal components fall down the wellbore.

Figure 23:
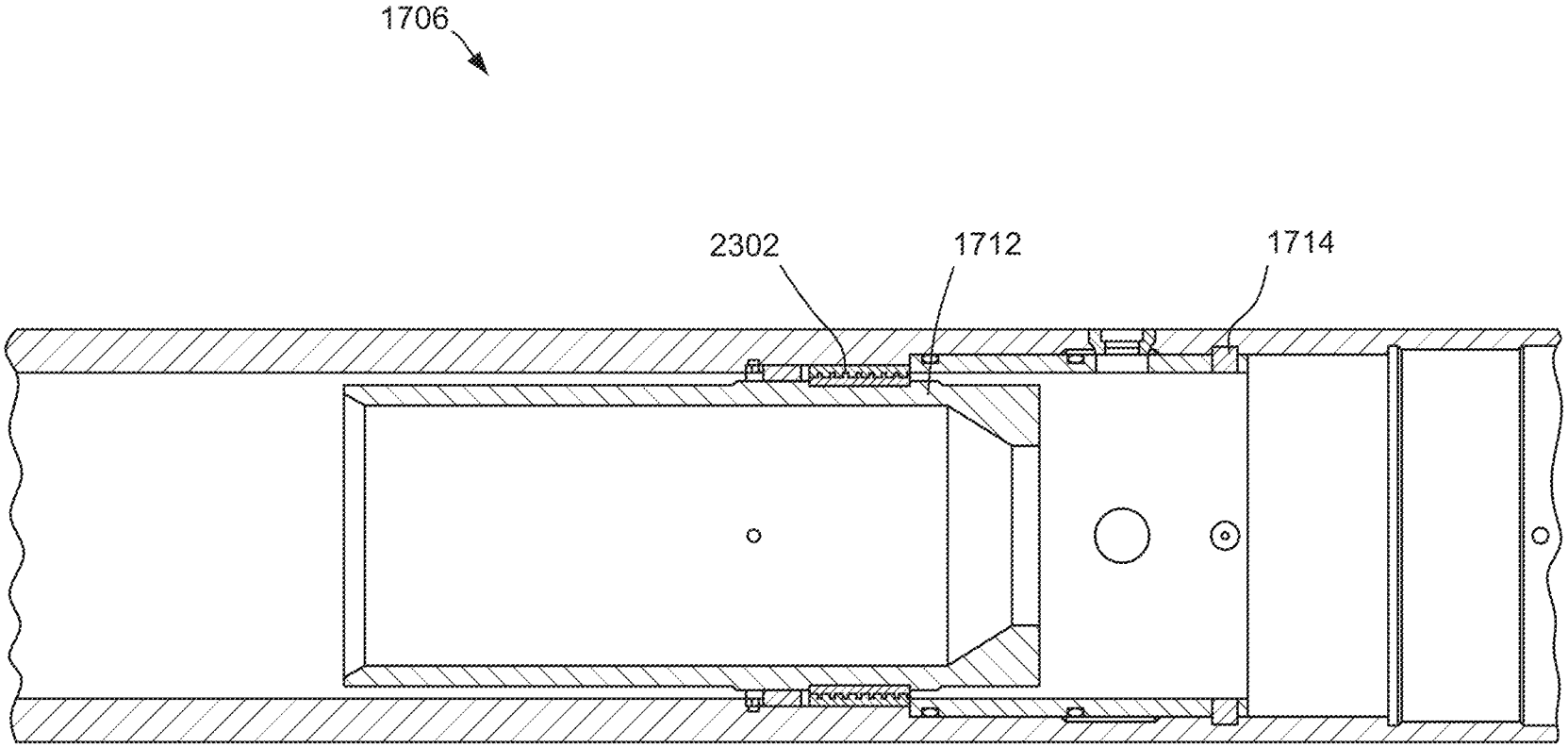
FIG. 23 is a cross-sectional view of a two piece split ring being held in place by a miniature packer in the configuration of FIG. 17.

Referring to FIG. 23, an expanded view of the stage tool 1706 is presented. The closing seat 1712 is held in place by a two-piece split ring 2302. And sealed by a miniature packer element that is compressed by the split ring 2302. The split ring 2302 is locked in place by shear screws 1714 on the closing sleeve.

Figure 24:
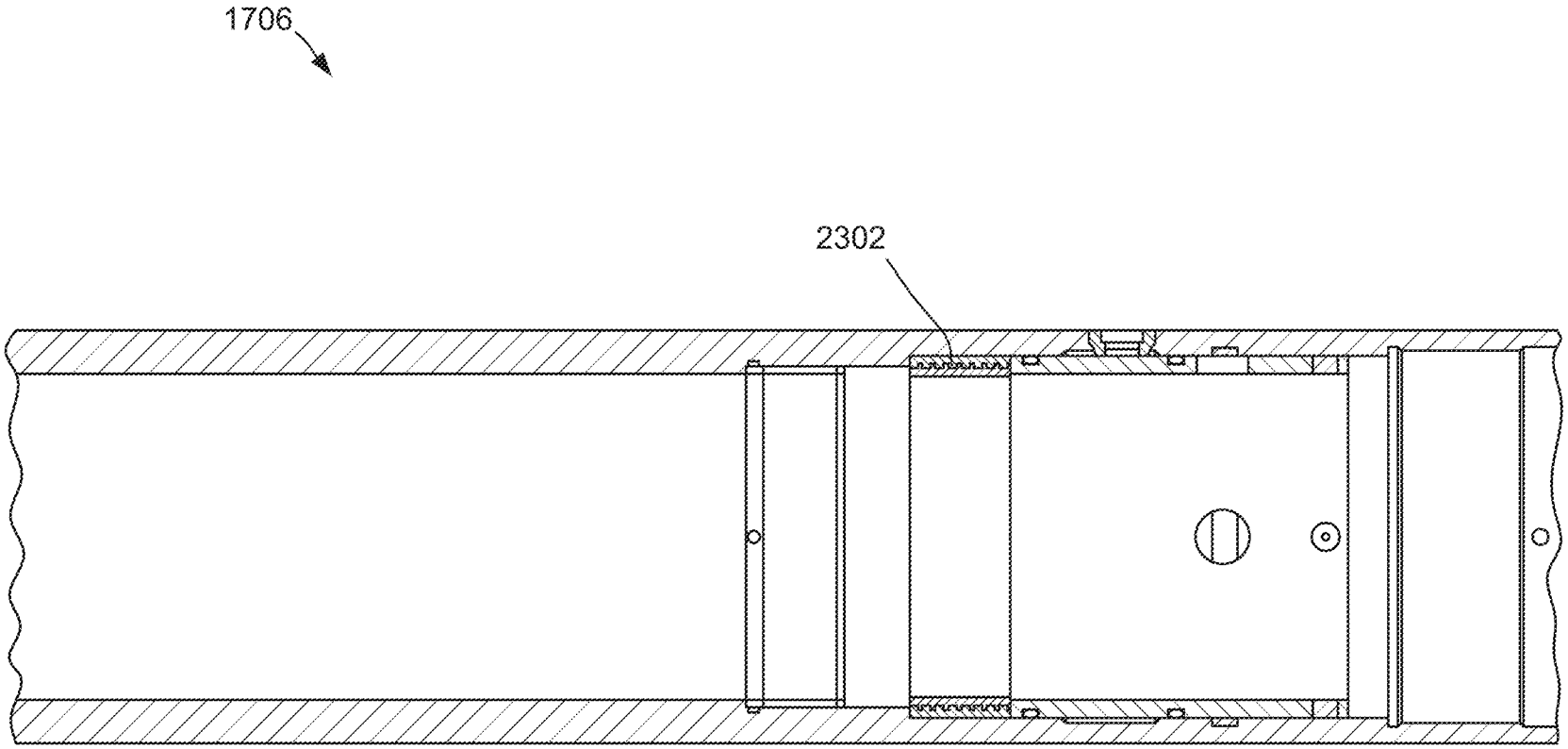
FIG. 24 is a cross-sectional view of the split ring opened thereby releasing the closing seat.

Referring to FIGS. 23 and 24, once shifted down, the split ring 2302 springs open and releases the closing seat 1712 while locking the closing sleeve in place and releasing the packer element. The closing plug 1710 is swallowed by the closing seat 1712 to allow it to free fall down the well. The two-piece split ring 2302 components, in one example embodiment, thread together and may unthread as a secondary release mechanism, if desired by operations personnel.

Figure 25:
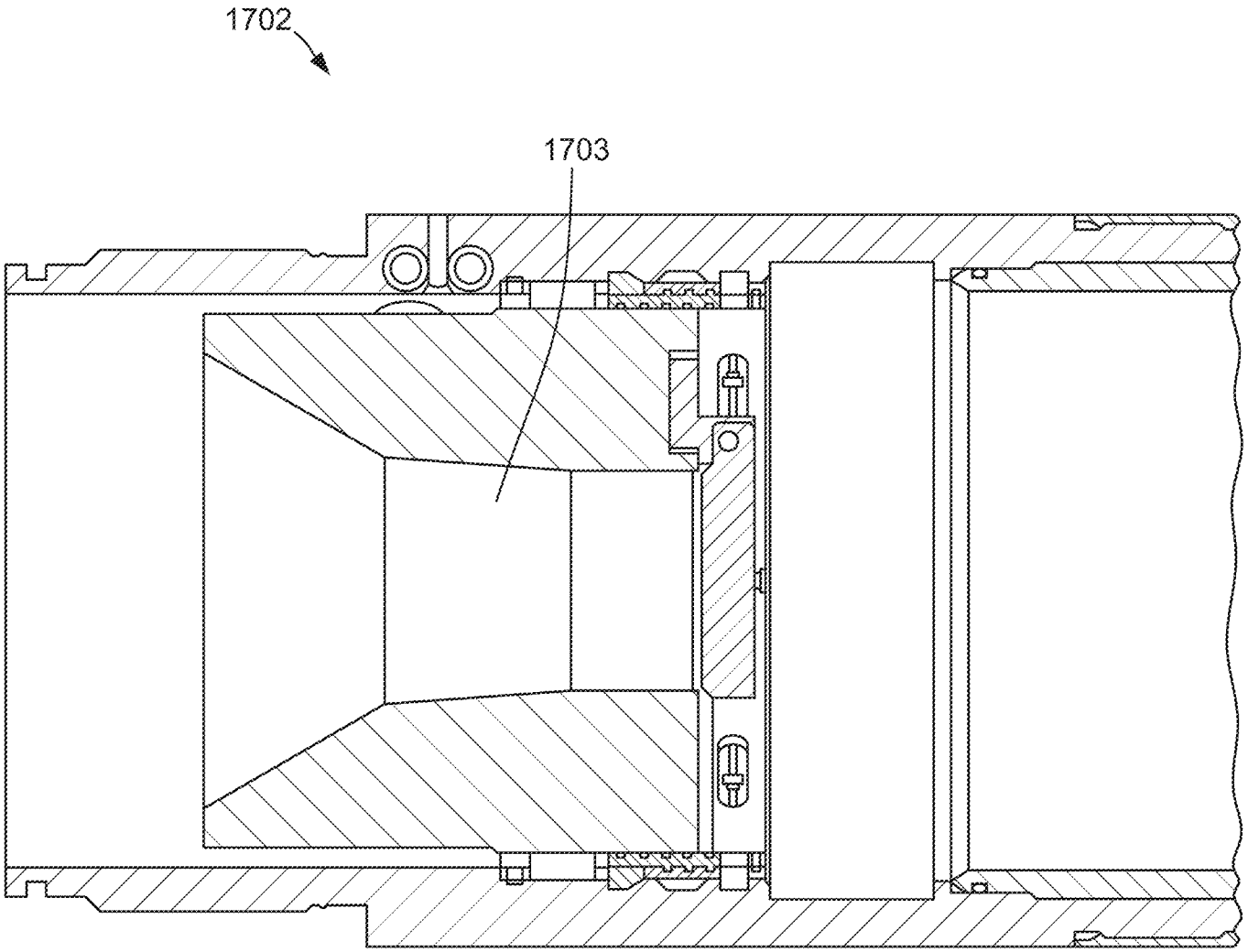
FIG. 25 is a first cross-sectional view of the float collar/ball seat of the configuration of FIG. 17.

Referring to FIG. 25, an expanded view of the float collar 1702 and ball seat 1703 are illustrated. The float collar 1702 and ball seat 1703 are held in place by a two-piece split ring and sealed by a miniature packer. The split ring keeps the packer element set while also holding forces from back pressure on the float collar. The two-piece spit ring components may unthread as a secondary release element/

Figure 26:
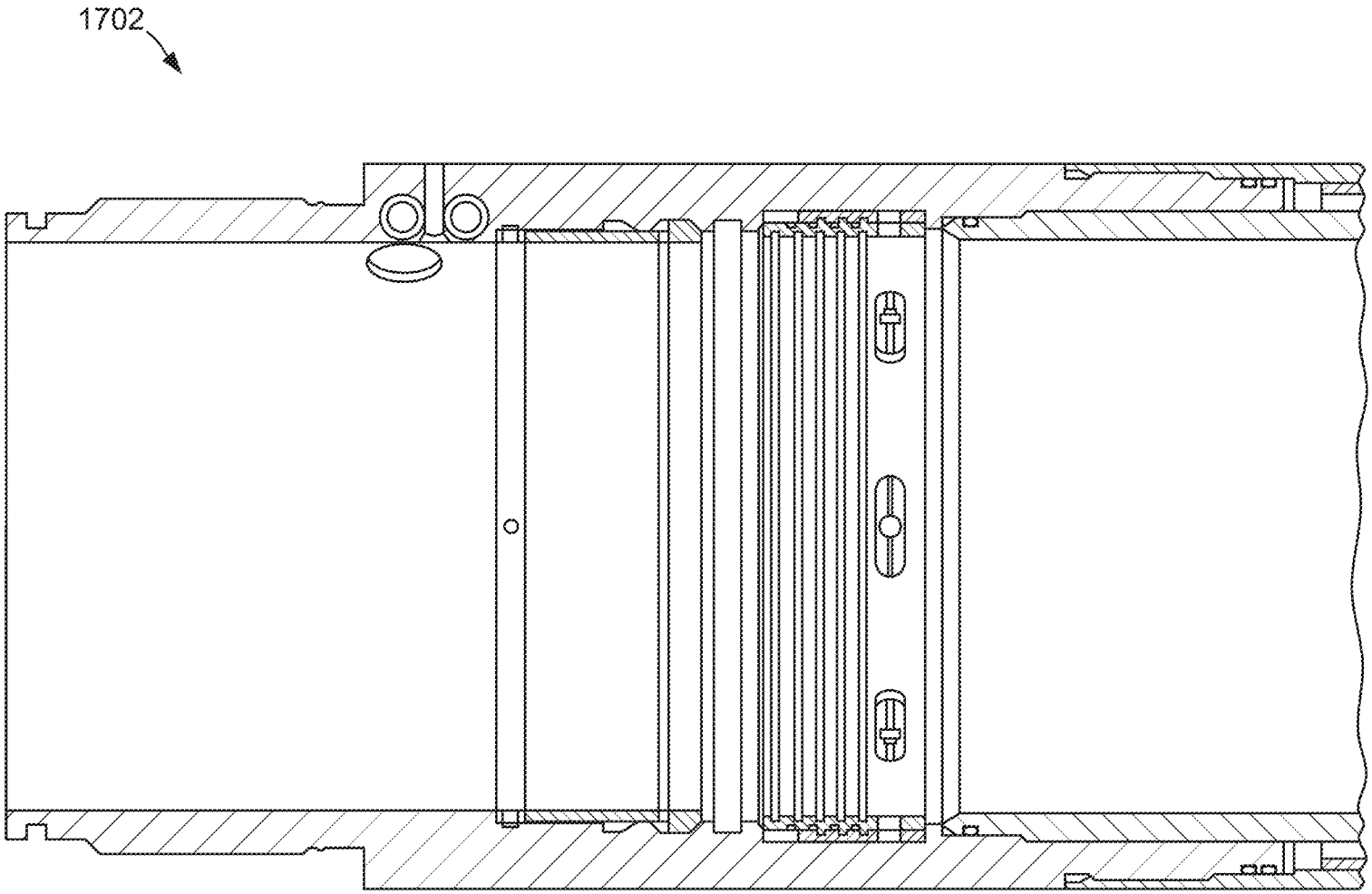
FIG. 26 is a second cross-sectional view of the float collar/ball seat of the configuration of FIG. 17.

Referring to FIG. 26, the expanded view of the float collar 1702 is presented wherein pressure from above shears the scores in the two piece split ring, thereby shifting the split ring down removing support for the split ring which is pushed into a groove by the packer element. The configuration, therefore, provides a float collar/ball seat that is released and falls downhole.

In one example embodiment, the apparatus may comprise a body configured to define an interior volume and a collar having a seat configured within the interior volume of the body, the seat configured to channel flow through the interior volume and configured to accept a dropped ball The apparatus may also be configured with a closing sleeve configured to extend from a first position to a second position, wherein in the first position, the closing sleeve is in an open position and in the second position, the closing sleeve is in a closed position. The apparatus may also be configured with a split ring configured within the interior volume located between the closing sleeve and the seat and a packer configured to extend from a first deflated position to a second inflated position. The apparatus may also be configured with a rupture disk and a plug configured to be placed within the interior volume, wherein an exterior of the plug is configured to extend to an interior diameter of the body.

In one example embodiment, the apparatus may be configured wherein the packer is configured to open to the second inflated position when a pressure limit is reached within the interior volume.

In one example embodiment, the apparatus may be configured wherein the rupture disk is configured to rupture at a predefined pressure within the interior volume.

In one example embodiment, the apparatus may be configured wherein the split ring is configured to interface with the closing sleeve and maintain the closing sleeve in the closed position.

In one example embodiment, the apparatus may be further configured with a groove on an interior surface of the body, wherein the split ring is placed within the groove.

In one example embodiment, the apparatus may be configured wherein the closing sleeve is configured to provide a boundary between the interior volume of the body when in the closed position and an annulus of a wellbore when in the open position.

In one example embodiment, a method for cementing a wellbore is disclosed. The method may comprise running an apparatus into the wellbore where cementing is to occur within the wellbore and dropping a ball within the apparatus, wherein the ball descends with gravity to an approximate elevation where cementing is to occur. The method may also comprise landing the ball on a seat within an interior volume of the apparatus and increasing a pressure within the apparatus. The method may also comprise setting a packer within an annulus of the wellbore after a pressure in the apparatus reaches a predefined limit. The method may also comprise rupturing a rupture disk with the apparatus establish a flow of cement within the apparatus. The method may also comprise filling an annulus of the wellbore with cement from the flow of cement out an open sleeve within the apparatus and inserting a plug within the apparatus. The method may also comprise transporting the plug to the seat, moving the sleeve to a closed position and shearing a float collar within the apparatus.

In another example embodiment, the method may be performed wherein the seat is part of a float collar.

In another example embodiment, the method may be performed wherein the landing of the ball results in a fluid flow blockage increasing a pressure within the apparatus.

In another example embodiment, the method may further comprise running a fluid within the apparatus interior volume prior to dropping the ball within the apparatus.

In another example embodiment, the method may be performed wherein the filling the annulus of the wellbore with cement from the flow of cement is with a predefined amount of cement.

In another example embodiment, the method may be performed wherein the shearing the float collar within the apparatus causes the seat to descend within the wellbore.

In another example embodiment, the method may be performed wherein a retainer split ring is used to maintain the sleeve in an open position.

In another example embodiment, an apparatus is disclosed. The apparatus may comprise a body configured to define an interior volume and a collar having a seat configured within the interior volume of the body, the seat configured to channel flow through the interior volume and configured to accept a dropped ball. The apparatus may also comprise a closing sleeve configured to extend from a first position to a second position, wherein in the first position, the closing sleeve is in an open position and in the second position, the closing sleeve is in a closed position. The apparatus may also comprise a split ring configured within the interior volume located between the closing sleeve and the seat. The apparatus may also comprise a packer configured with a float valve, the packer configured to extend from a first deflated position to a second inflated position. The apparatus may also comprise a rupture disk and a plug configured to be placed within the interior volume, wherein an exterior of the plug is configured to extend to an interior diameter of the body.

In another example embodiment, the method may be performed wherein the packer is configured to open to the second inflated position when a pressure limit is reached within the interior volume.

In another example embodiment, the method may be performed wherein the rupture disk is configured to rupture at a predefined pressure within the interior volume.

In another example embodiment, an apparatus is disclosed. The apparatus may comprise a body configured to define an interior volume and a float collar having a seat configured within the interior volume of the body, the seat configured to channel flow through the interior volume and configured to accept a dropped ball. The apparatus may also comprise a closing sleeve configured to extend from a first position to a second position, wherein in the first position, the closing sleeve is in an open position and in the second position, the closing sleeve is in a closed position, the closing sleeve having a closing seat and a split ring configured within the interior volume located between the closing sleeve and the seat. The apparatus may also comprise a rupture disk configured to rupture at a predefined pressure within the interior volume of the body and a plug configured to be placed within the interior volume, wherein an exterior of the plug is configured to extend to an interior diameter of the body, the plug configured to be accepted by the closing seat.

In another example embodiment, the apparatus may further comprise at least one set of screws configured to hold the closing sleeve in the first position and shear in the second position.

In another example embodiment, the apparatus may be configured wherein the float collar is located downhole from the closing sleeve.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. An apparatus for a wellbore cementing operation, comprising:

a body configured to define an interior volume;

a collar having a ball seat configured within the interior volume of the body, the ball seat configured to channel flow through the interior volume and configured to accept a dropped ball that obstructs flow through the body when disposed on the ball seat;

a closing sleeve configured to be shifted from an open position to a closed position within the body, wherein in the open position a fluid pathway between the interior volume of the body and a wellbore annulus is unblocked, and in the closed position the fluid pathway is blocked;

a closing seat configured to accept a cement wiper plug; and a split ring configured within the interior volume located between the closing seat and the body, wherein the split ring is shiftable with the closing sleeve between a retained configuration when the closing sleeve is in the open position and an expanded configuration when the closing sleeve is in the closed position, wherein the split ring holds the closing seat in place within the body in the retained configuration and releases the closing seat to pass through the body and fall downhole in the expanded configuration.

2. The apparatus according to claim 1, wherein the split ring abuts the closing sleeve that is initially held in the open position by shear screws.

3. The apparatus according to claim 1, wherein the ball seat is further selectively releasable to pass through the body and fall downhole based upon pressure in the body above the ball seat.

4. The apparatus according to claim 1, wherein the split ring is configured to interface with the closing sleeve and maintain the closing sleeve in the closed position.

5. The apparatus according to claim 1, further comprising:

a groove on an interior surface of the body, wherein the split ring is placed within the groove in the expanded configuration.

6. The apparatus according to claim 1, wherein the split ring is a two-piece split ring capable of unthreading as a secondary release of the closing sleeve from the body.

7. The apparatus according to claim 1, wherein the collar is located downhole from the closing sleeve.

8. The apparatus according to claim 1, wherein the closing sleeve is shiftable from the open position to the closed position based upon pressure in the body above the closing seat.

9. The apparatus according to claim 1, wherein both the closing seat and ball seat are selectively releasable to pass through the body and fall downhole based upon pressure in the body respectively above the closing seat and the ball seat.

10. The apparatus according to claim 1, further comprising a collar split ring that selectively retains the collar and the ball seat in the body up to a threshold pressure in the body above the ball seat, wherein the collar split ring is shifted from a supported position into a groove by the threshold pressure thereby releasing the collar and the ball seat from the body to fall downhole.

11. The apparatus according to claim 1, further comprising a collar split ring that selectively retains the collar and the ball seat in the body up to a threshold pressure in the body above the ball seat, wherein the collar split ring is a two-piece split ring capable of unthreading as a secondary release of the collar and the ball seat from the body.

12. The apparatus according to claim 1, wherein the collar is a float collar for the wellbore cementing operation.

13. The apparatus according to claim 1, wherein the split ring and the closing sleeve maintain abutting contact in both the open and closed position of the closing sleeve.

14. The apparatus according to claim 1, wherein the split ring is supported by an interior surface of the body in the retained configuration and is placed within a groove on the interior surface of the body in the expanded configuration.

* * * * *